US010530068B2

(12) United States Patent
Mirmozafari et al.

(10) Patent No.: US 10,530,068 B2
(45) Date of Patent: Jan. 7, 2020

(54) DUAL-LINEAR-POLARIZED, HIGHLY-ISOLATED, CROSSED-DIPOLE ANTENNA AND ANTENNA ARRAY

(71) Applicant: The Board of Regents of the University of Oklahoma, Norman, OK (US)

(72) Inventors: Mirhamed Mirmozafari, Norman, OK (US); Guifu Zhang, Norman, OK (US)

(73) Assignee: The Board of Regents of the University of Oklahoma, Norman, OK (US)

( * ) Notice: Subject to any disclaimer, the term of this patent is extended or adjusted under 35 U.S.C. 154(b) by 0 days.

(21) Appl. No.: 16/039,102

(22) Filed: Jul. 18, 2018

(65) Prior Publication Data

US 2019/0140364 A1 May 9, 2019

Related U.S. Application Data

(60) Provisional application No. 62/534,062, filed on Jul. 18, 2017.

(51) Int. Cl.
*H01Q 21/26* (2006.01)
*H01Q 25/00* (2006.01)
(Continued)

(52) U.S. Cl.
CPC ..... *H01Q 25/001* (2013.01); *H01Q 5/48* (2015.01); *H01Q 9/0478* (2013.01); *H01Q 21/26* (2013.01)

(58) Field of Classification Search
CPC ..... H01Q 21/26; H01Q 25/001; H01Q 5/48; H01Q 9/0478
See application file for complete search history.

(56) References Cited

U.S. PATENT DOCUMENTS 4,686,536 A * 8/1987 Allcock ..... H01Q 9/065 343/700 MS
5,280,297 A * 1/1994 Profera, Jr. ..... H01Q 3/46 343/700 MS (Continued)

FOREIGN PATENT DOCUMENTS

JP 2000151268 A * 5/2000 ..... H01Q 21/26

OTHER PUBLICATIONS

Bao, Zengdi, et al.; "Design and Discussion of a Broadband Cross-Dipole with High Isolation and Low Cross-Polarisation Utilising Strong Mutual Coupling"; IET Microwaves, Antennas & Propagation; vol. 8, Iss. 5; 2014; 8 pages.

(Continued)

*Primary Examiner* — Hoang V Nguyen
(74) *Attorney, Agent, or Firm* — Conley Rose, P.C.; Grant Rodolph; Jonathan K. Polk

(57) ABSTRACT

A dual linear polarized dipole antenna (and arrays of such antennas) having high isolation between ports. The antenna may include a pair of crossed (collocated) bent (angled) dipole antenna elements which are excited by a unique dual-polarized feeding structure. The antenna elements may be printed. Stripline feeding along with substantially symmetrical and substantially identical radiative (e.g., "radiating") elements results in high level of port isolation. Subground planes may be positioned about the stripline on both sides of a balun block to limit or reduce parasitic stripline radiation, thereby improving polarization purity. Polarization purity may be additionally reinforced by a principal ground plane which isolates the radiative elements from the baluns. The antennas and antenna arrays may be used, for example, for weather observation and air surveillance.

20 Claims, 20 Drawing Sheets

(51) Int. Cl.
*H01Q 5/48* (2015.01)
*H01Q 9/04* (2006.01)

(56) References Cited

U.S. PATENT DOCUMENTS 6,034,649 A * 3/2000 Wilson ..... H01Q 1/246 343/795
2012/0081259 A1* 4/2012 Regala ..... H01Q 21/26 343/797

OTHER PUBLICATIONS

Croq, Frederic, et al.; "Millimeter-Wave Design of Wide-Band Aperture-Coupled Stacked Microstrip Antennas"; IEEE Transactions on Antennas and Propagation; vol. 39, No. 12; Dec. 1991; 7 pages.
Gou, Yanshan, et al.; "A Compact Dual-Polarized Printed Dipole Antenna with High Isolation for Wideband Base Station Applications"; IEEE Transactions on Antennas and Propagation; vol. 62, No. 8; Aug. 2014; 4 pages.
Herd, J., et al.; "Advanced Architecture for a Low Cost Multifunction Phased Array Radar"; IEEE MTT-S International Microwave Symposium; 2010; 4 pages.
Huynh, T., et al.; "Crosspolarisation Characteristics of Rectangular Patch Antennas"; Electronics Letters; vol. 24, No. 8; Apr. 14, 1988; 2 pages.
Lindmark, Bjorn; "A Novel Dual Polarized Aperture Coupled Patch Element with a Single Layer Feed Network and High Isolation"; IEEE Antennas and Propagation Society International Symposium; 1997; 4 pages.
Mirmozafari, Mirhamed, et al.; "An Overview of Dual Polarized Isolated Antennas"; IEEE International Symposium on Antennas and Propagation (APSURSI); 2016; 2 pages.
Mishra, Prashant K., et al.; "A Review of Broadband Dual Linearly Polarized Microstrip Antenna Designs with High Isolation"; IEEE Antennas and Propagation Magazine; vol. 56, No. 6; Dec. 2014; 14 pages.
Rao, Sadasiva M., et al.; "Electromagnetic Radiation and Scattering from Finite Conducting and Dielectric Structures: Surface/Surface Formulation"; IEEE Transactions on Antennas and Propagation; vol. 39, No. 7; Jul. 1991; 4 pages.
Vaughan, Rodney G., et al.; "Antenna Diversity in Mobile Communications"; IEEE Transactions on Vehicular Technology; vol. VT-36, No. 4; Nov. 1987; 24 pages.
Wong, Hang, et al.; "Design of Dual-Polarized L-Probe Patch Antenna Arrays with High Isolation"; IEEE Transactions on Antennas and Propagation; vol. 52, No. 1; Jan. 2004; 8 pages.
Zhang, Guifu, et al.; "A Cylindrical Polarimetric Phased Array Radar Concept—A Path to Multi-Mission Capability"; IEEE International Symposium on Phased Array Systems and Technology; 2013; 4 pages.
Zhong, Shun-Shi, et al.; "Corner-Fed Microstrip Antenna Element and Arrays for Dual-Polarization Operation"; IEEE Transactions on Antennas and Propagation; vol. 50, No. 10; Oct. 2002; 8 pages.

* cited by examiner

DUAL-LINEAR-POLARIZED, HIGHLY-ISOLATED, CROSSED-DIPOLE ANTENNA AND ANTENNA ARRAY

CROSS-REFERENCE TO RELATED APPLICATIONS

This application claims priority to U.S. provisional patent application No. 62/534,062 filed on Jul. 18, 2017 by The Board of Regents of the University of Oklahoma and titled "Dual-Linear Polarized Highly Isolated Crossed Dipole Antenna and Antenna Array," which is incorporated herein by reference in its entirety.

STATEMENT REGARDING FEDERALLY SPONSORED RESEARCH OR DEVELOPMENT

This application was supported by the National Oceanic and Atmospheric Administration under Grant NA11OAR4320072. The government has certain rights in this invention.

BACKGROUND

To accommodate weather observation and air surveillance requirements concurrently, the MPAR has been proposed as a solution. Since each function demands precise features, radar components are being upgraded to meet stringent requirements such as matched co-polarization patterns, highly-isolated dual polarization, and low cross-polarization level over the entire frequency bandwidth.

Dual linear-polarized antennas have been introduced as an appropriate solution to meet the aforementioned requirements and are undergoing significant developments. Microstrip patch antennas, owing to their low profile and ease of fabrication, make up a large percentage of such proposed dual-polarized antennas. Based on their feeding techniques, they can be categorized into different types: microstrip-fed, probe-fed, and aperture-coupled antennas. The highest isolation reported in microstrip-fed and probe-fed antennas is 30 dB. Feedline parasitic interference and stimulation of higher-order modes degrade the polarization purity in microstrip-fed and probe-fed antennas. Aperture-coupled antennas sacrifice some antenna features such as gain, simplicity, and low back lobe radiation to achieve a high level of isolation. Various aperture configurations have been suggested and up to 35 dB port-to-port isolation has been reported. To further enhance isolation and cross-polarization levels, differential feed methods have been studied. However, the implementation of two differential feeds in a single layer is challenging and it often results in gain loss, larger antenna area, or bulky multilayer structures.

Similar orthogonal structures such as cross dipoles and cross slots form another category. One proposed non-planar cross dipole provides 34 dB port-to-port isolation. However, due to a high sensitivity to fabrication tolerances, the antenna cross-polarization is severely degraded. In contrast, an easy-to-fabricate printed dipole with 35 dB port-to-port isolation was reported to suffer from collocation of co- and cross-polarization peaks in radiation pattern.

Thus the design of a dual-polarization antenna with high isolation between ports has always been a challenge to antenna designers. The novel antenna configurations of the present disclosure address the deficiencies of the previously proposed antenna designs.

BRIEF DESCRIPTION OF THE DRAWINGS

Several embodiments of the present disclosure are hereby illustrated in the appended drawings. It is to be noted however, that the appended drawings only illustrate several embodiments and are therefore not intended to be considered limiting of the scope of the present disclosure.

DETAILED DESCRIPTION

Figure 1A:
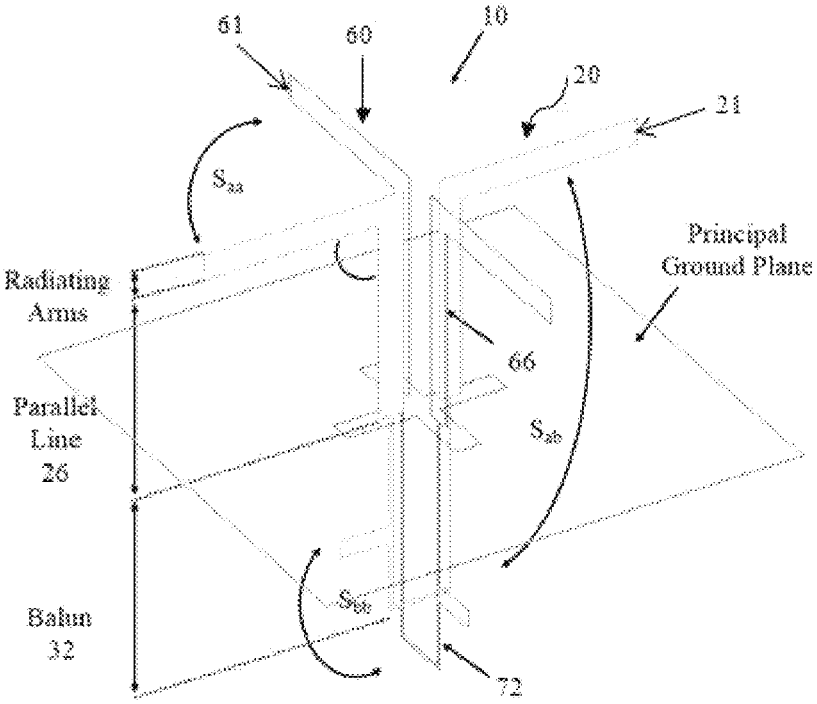
FIG. 1A is a perspective view of the basic construction of an example of the crossed-dipole antenna of the present disclosure.

The present disclosure is directed to a dual linear polarized dipole antenna (and arrays of such antennas) having high isolation between ports. The antenna comprises, in a non-limiting embodiment, a pair of crossed (collocated) bent (angled) dipole antenna elements which are excited by a unique dual-polarized feeding structure. The antenna elements may be printed. Stripline feeding along with substantially symmetrical and substantially identical radiative (e.g., "radiating") elements results in high level of port isolation. Sub-ground planes positioned about the stripline on both sides of the balun block, limit, or reduce parasitic stripline radiation, thereby improving polarization purity (e.g., resulting in pure polarization). Polarization purity is additionally reinforced by the principal ground plane which isolates the radiative elements from the baluns. In certain embodiments, the crossed dipole antennas described herein have a match between parameters $S_{11}$ and $S_{22}$, high port isolation over a wider bandwidth, and a high match between corresponding E-plane and H-plane patterns. Due to substantially identical radiating structures (e.g., radiative elements), similar co-polarization patterns are achieved, which is an appropriate feature for weather applications. The antennas may be constructed using inexpensive printed circuit board (PCB) technology. The antennas and antenna arrays of the present disclosure may be used for weather observation and air surveillance in non-limiting embodiments.

Before describing various embodiments of the present disclosure in more detail by way of exemplary description, examples, and results, it is to be understood that the present disclosure is not limited in application to the details of methods and compositions as set forth in the following description. The present disclosure is capable of other embodiments or of being practiced or carried out in various ways. As such, the language used herein is intended to be given the broadest possible scope and meaning; and the embodiments are meant to be exemplary, not exhaustive. Also, it is to be understood that the phraseology and terminology employed herein is for the purpose of description and should not be regarded as limiting unless otherwise indicated as so. Moreover, in the following detailed description, numerous specific details are set forth in order to provide a more thorough understanding of the disclosure. However, it will be apparent to a person having ordinary skill in the art that the embodiments of the present disclosure may be practiced without these specific details. In other instances, features which are well known to persons of ordinary skill in the art have not been described in detail to avoid unnecessary complication of the description.

Unless otherwise defined herein, scientific and technical terms used in connection with the present disclosure shall have the meanings that are commonly understood by those having ordinary skill in the art. Further, unless otherwise required by context, singular terms shall include pluralities and plural terms shall include the singular.

All patents, published patent applications, and non-patent publications mentioned in the specification are indicative of the level of skill of those skilled in the art to which the present disclosure pertains. All patents, published patent applications, and non-patent publications referenced in any portion of this application are herein expressly incorporated by reference in their entirety to the same extent as if each individual patent or publication was specifically and individually indicated to be incorporated by reference.

As utilized in accordance with the methods and compositions of the present disclosure, the following terms, unless otherwise indicated, shall be understood to have the following meanings:

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or when the alternatives are mutually exclusive, although the disclosure supports a definition that refers to only alternatives and "and/or." The use of the term "at least one" will be understood to include one as well as any quantity more than one, including but not limited to, 2, 3, 4, 5, 6, 7, 8, 9, 10, 15, 20, 30, 40, 50, 100, or any integer inclusive therein. The term "at least one" may extend up to 100 or 1000 or more, depending on the term to which it is attached; in addition, the quantities of 100/1000 are not to be considered limiting, as higher limits may also produce satisfactory results. In addition, the use of the term "at least one of X, Y and Z" will be understood to include X alone, Y alone, and Z alone, as well as any combination of X, Y and Z.

As used herein, all numerical values or ranges include fractions of the values and integers within such ranges and fractions of the integers within such ranges unless the context clearly indicates otherwise. Thus, to illustrate, reference to a numerical range, such as 1-10 includes 1, 2, 3, 4, 5, 6, 7, 8, 9, 10, as well as 1.1, 1.2, 1.3, 1.4, 1.5, etc., and so forth. Reference to a range of 1-50 therefore includes 1, 2, 3, 4, 5, 6, 7, 8, 9, 10, 11, 12, 13, 14, 15, 16, 17, 18, 19, 20, etc., up to and including 50, as well as 1.1, 1.2, 1.3, 1.4, 1.5, etc., 2.1, 2.2, 2.3, 2.4, 2.5, etc., and so forth. Reference to a series of ranges includes ranges which combine the values of the boundaries of different ranges within the series. Thus, to illustrate reference to a series of ranges, for example, of 1-10, 10-20, 20-30, 30-40, 40-50, 50-60, 60-75, 75-100, 100-150, 150-200, 200-250, 250-300, 300-400, 400-500, 500-750, 750-1,000, includes ranges of 1-20, 10-50, 50-100, 100-500, and 500-1,000, for example. A reference to degrees such as 1 to 90 is intended to explicitly include all degrees in the range.

As used herein, the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. The skilled artisan will understand that typically there is no limit on the number of items or terms in any combination, unless otherwise apparent from the context.

Throughout this application, the term "about" is used to indicate that a value includes the inherent variation of error. Further, in this detailed description, each numerical value (e.g., temperature or time) should be read once as modified by the term "about" (unless already expressly so modified), and then read again as not so modified unless otherwise indicated in context. As noted, any range listed or described herein is intended to include, implicitly or explicitly, any number within the range, particularly all integers, including the end points, and is to be considered as having been so stated. For example, "a range from 1 to 10" is to be read as indicating each possible number, particularly integers, along the continuum between about 1 and about 10. Thus, even if specific data points within the range, or even no data points within the range, are explicitly identified or specifically referred to, it is to be understood that any data points within the range are to be considered to have been specified, and that the inventors possessed knowledge of the entire range and the points within the range. The use of the term "about" may mean a range including ±10% of the subsequent number unless otherwise stated.

As used herein, the term "substantially" means that the subsequently described parameter, event, or circumstance completely occurs or that the subsequently described parameter, event, or circumstance occurs to a great extent or degree. For example, the term "substantially" means that the subsequently described parameter, event, or circumstance occurs at least 90% of the time, or at least 91%, or at least 92%, or at least 93%, or at least 94%, or at least 95%, or at least 96%, or at least 97%, or at least 98%, or at least 99%, of the time, or means that the dimension or measurement is within at least 90%, or at least 91%, or at least 92%, or at least 93%, or at least 94%, or at least 95%, or at least 96%, or at least 97%, or at least 98%, or at least 99%, of the referenced dimension or measurement (e.g., length).

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

The following abbreviations apply:

CPPAR: cylindrical polarimetric phased array radar
dB: decibel(s)
ECC: envelope correlation coefficient
GHz: gigahertz
HFSS: high-frequency structure simulator
MHz: megahertz
MIMO: multiple-input and multiple-output
m: meter(s)
mm: millimeter(s)
$mm^2$: squared millimeter(s)
MPAR: multi-function phased array radar
PCB: printed circuit board
SMA: SubMiniature version A
VSWR: voltage standing wave ratio
Ω: ohm(s).

Returning to the detailed description, in one non-limiting embodiment of the antenna, a balun comprising parallel feed lines is designed for MPAR in the frequency bandwidth of (but not limited to) 2.7-3 GHz. To increase or maximize the polarization purity of the antenna and to reduce, limit, or eliminate the parasitic radiation of the balun, the radiating element is isolated from the balun by a set of ground planes (principal ground plane and sub-ground planes). A return loss exceeding 10 dB and a measured port-to-port isolation of 52 dB, over the whole bandwidth, are achieved. The cross-polarization pattern remains 40 dB below the co-polarization peak in the principal planes. The peak of the co-polarization coincides with the null of the cross-polarization with a difference of 50 dB, which makes it a good (or an ideal) solution for weather applications and array performance. High isolation along with low ECC enable the antenna to perform appropriately in MIMO applications as well.

Having a compact geometry, a plurality of the disclosed antennas can readily be extended to form a linear array having dual polarization. In one embodiment, the crossed dipoles comprise an angular bend (e.g., 30° deflection from a horizontal line) for achieving a wider scan element pattern. The antenna maintains an active VSWR less than 2:1 at 2.7-3 GHz while scanning up to ±45° in E-plane. A unique configuration of elements may be employed in the linear array, reducing the cross-polarization in principal planes down to −40 dB below the co-polarization peak while scanning up to ±45° in the E-plane. In one non-limiting example, a linear array of eight antenna elements was fabricated for simulation studies.

EXAMPLES

The inventive concepts of the present disclosure will now be discussed in terms of several specific, non-limiting examples. The examples described below, which include particular embodiments, will serve to illustrate the practice of the present disclosure, it being understood that the particulars shown are by way of example and for purposes of illustrative discussion of particular embodiments of the present disclosure only and are presented in the cause of providing what is believed to be a useful and readily understood description of construction procedures as well as of the principles and conceptual aspects of the inventive concepts.

Example 1

Theory and Design

FIG. 1A presents one non-limiting embodiment of an antenna design of the present disclosure. A crossed-dipole antenna 10 is constructed with a first dipole element 20 (e.g., a first antenna assembly) orthogonally positioned with respect to a second dipole element 60 (e.g., a second antenna assembly). For each polarization, each dipole element of the pair of dipole elements 20, 60 includes a radiative element (e.g., radiating arms or poles) connected to a parallel transmission line (also referred to herein as a parallel line) and is placed a quarter wavelength (e.g., of an operating frequency of the crossed-dipole antenna 10) above a principal ground plane 55. For example, the first dipole element 20 includes a radiative element 21 connected to a parallel line 26, and the radiative element 21 is located approximately a quarter wavelength above the principal ground plane 55. As another example, the second dipole element 60 includes a radiative element 61 connected to a parallel line 66, and the radiative element 61 is located approximately a quarter wavelength above the principal ground plane 55. The radiating arms of the radiative elements 21 and 61 may be bent or angled, for example, as described below with reference to FIGS. 1B and 1C. Below the principal ground plane 55, the parallel line of each dipole element is attached to a balun constructed of two parallel feedlines. For example, the parallel line 26 is attached to a balun 32, and the parallel line 66 is attached to a balun 72. During operation, the signals at the ends of the two parallel feedlines of a balun (e.g., where the two parallel feed lines of a balun couple to branches of a parallel line) are 180° out of phase from each other, providing a balanced differential port. During operation, signals at the ends of the two parallel feed lines of a balun will substantially maintain their 180° phase difference as the signals propagate through respective parallel lines and a corresponding radiative element. For example, during operation, a first signal at the end of a first feedline 34 of the balun 32 may be 180° out of phase relative to a second signal at the end of a second feedline 36 of the balun 32, and the first and second signals will substantially maintain the 180° phase difference as the first and second signals propagate through respective branches 28, 30 of the parallel line 26 and through respective radiating arms 22, 24 of the radiative element 21. Each of the parallel lines 26, 66 is attached to a differential port through a cross-shaped slot cut 92 in the principal ground plane 55. To have collocated orthogonal dipoles without intersection, the two baluns 32 and 72 may have different lengths or may have the same lengths with configurations that allow collocation without intersection (e.g., see FIGS. 18-19).

Figure 1B:
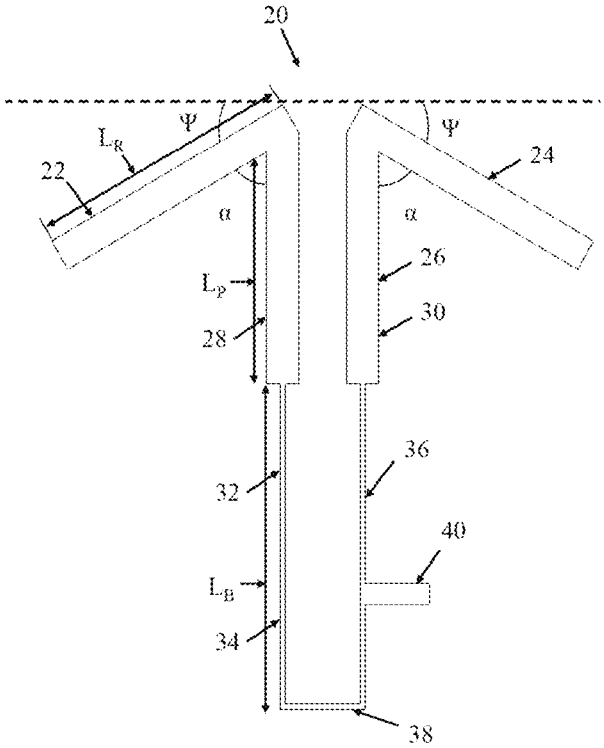
FIG. 1B is a side view of one embodiment of a first dipole element used in the construction of a crossed-dipole antenna of the present disclosure.

FIG. 1B depicts one non-limiting example of the first dipole element 20 of the crossed-dipole antenna 10. The first dipole element 20 has a first radiating arm 22 and a second radiating arm 24. Each first radiating arm 22 and second radiating arm 24 has a length $L_R$ and a width $W_R$. The parallel line 26 comprises a first branch 28 connected to the first radiating arm 22 and a second branch 30 connected to the second radiating arm 24. The parallel line 26 (and thus each branch 28 and 30) has a length $L_P$. Each branch 28 and 30 of the parallel line 26 has a width $W_P$. The balun 32 comprises a first feedline 34 extending from the first branch 28 and a second feedline 36 extending from the second branch 30. The balun 32 has a length $L_B$, and each first feedline 34 and second feedline 36 has a width $W_B$. A tab extension 40, which extends from the balun 32, provides an extension for attaching to a connector such as an SMA connector for connecting the balun 32 to an electrical current source. The first feedline 34 has a J shape and extends from the first branch 28 to the tab extension 40. In non-limiting embodiments, the first feedline 34 has a horizontal portion 38. The second feedline 36 is straight and extends from the second branch 30 to the tab extension 40. In at least certain embodiments, the first feedline 34 has a total length (from first branch 28 to tab extension 40) that is greater than a total length of the second feedline 36 (from second branch 30 to tab extension 40). The balun 32 has a total balun length comprising the length of first feedline 34 plus the length of second feedline 36. The first radiating arm 22 and the second radiating arm 24 extend at an angle $\alpha$ from the first branch 28 and second branch 30, respectively, of the parallel line 26, wherein $1° \leq \alpha \leq 90°$. In one embodiment, $\alpha=60°$. Similarly, the first radiating arm 22 and the second radiating arm 24 extend at an angle $\Psi$ from a horizontal line perpendicular to the parallel line 26, wherein $1° \leq \Psi 90°$. In one embodiment, $\Psi=30°$.

Figure 1C:
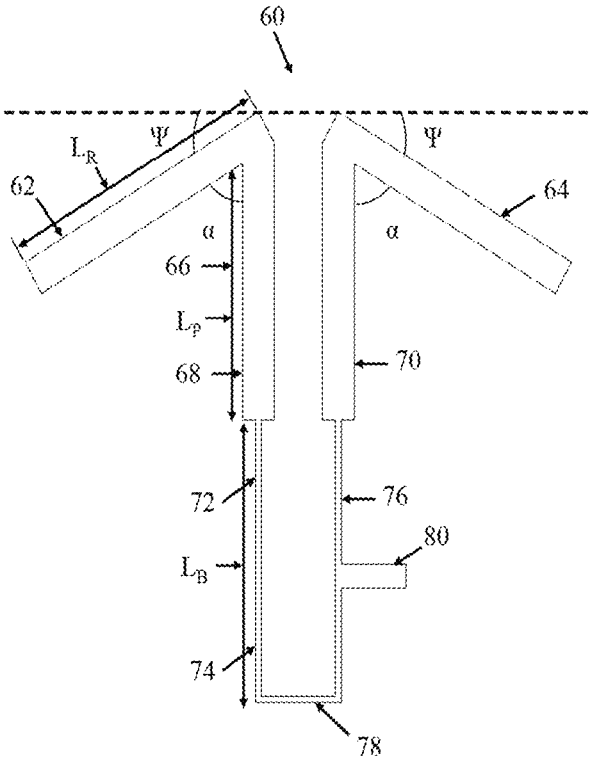
FIG. 1C is a side view of one embodiment of a second dipole element used with the first dipole element of FIG. 1B in the construction of a crossed-dipole antenna of the present disclosure.

FIG. 1C depicts one non-limiting example of the second dipole element 60 of the crossed-dipole antenna 10. The second dipole element 60 has a first radiating arm 62 and a second radiating arm 64. Each of the first radiating arm 62 and the second radiating arm 64 has a length $L_R$ and a width $W_R$. A parallel line 66 comprises a first branch 68 connected to the first radiating arm 62 and a second branch 70 connected to the second radiating arm 64. The parallel line 66 (and thus each branch 68 and 70) has a length $L_P$. Each branch 68 and 70 of the parallel line 66 has a width $W_P$. A balun 72 comprises a first feedline 74 extending from the first branch 68 and a second feedline 76 extending from the second branch 70. The balun 72 has a length $L_B$, and each first feedline 74 and second feedline 76 has a width $W_B$. A tab extension 80, which extends from the balun 72, provides an extension for attaching to a connector such as an SMA connector for connecting the balun 72 to an electrical current source. The first feedline 74 has a J shape and extends from the first branch 68 to the tab extension 80. In non-limiting embodiments, the first feedline 74 has a horizontal portion 78. The second feedline 76 is straight and extends from the second branch 70 to the tab extension 80. In at least certain embodiments, the first feedline 74 has a total length (from the first branch 68 to the tab extension 80) that is greater than a total length of the second feedline 76 (from the second branch 70 to the tab extension 80). The balun 72 has a total balun length comprising the length of first feedline 74 plus the length of second feedline 76. The first radiating arm 62 and the second radiating arm 64 extend at an angle $\alpha$ from the first branch 68 and second branch 70, respectively, of the parallel line 66, wherein $1° \leq \alpha \leq 90°$. In one embodiment, $\alpha=60°$. Similarly, the first radiating arm 62 and the second radiating arm 64 extend at an angle $\Psi$ from a horizontal line perpendicular to the parallel line 66, wherein $1° \leq \Psi \leq 90°$. In one embodiment, $\Psi=30°$.

In at least one embodiment, the total balun length of the balun 32 is unequal to the total balun length of the balun 72. In an alternate embodiment of a crossed-dipole antenna with a different balun configuration, the total balun length of the first balun is equal to the total balun length of the second balun, e.g., see FIGS. 18-19.

Figure 1D:
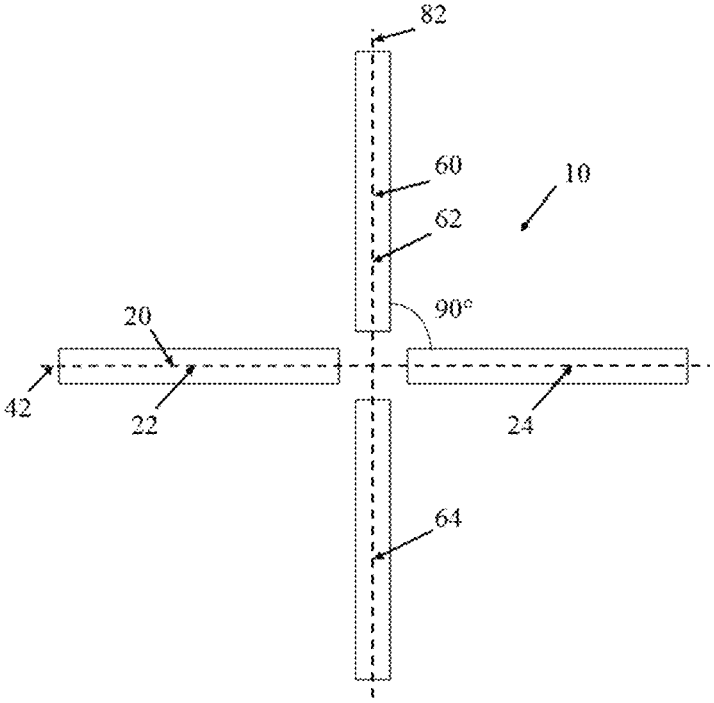
FIG. 1D is a top view of a crossed-dipole antenna of the present disclosure constructed by the collocation of the two dipole elements of FIGS. 1B-1C.

FIG. 1D shows a top view of the first dipole element 20 and the second dipole element 60 in an orthogonal arrangement to form the crossed dipole antenna 10. The first dipole element 20 has an axis 42 along the first radiating arm 22 and the second radiating arm 24, and the second dipole element 60 has an axis 82 along the first radiating arm 62 and the second radiating arm 64. The axis 42 and the axis 82 are oriented perpendicularly to each other to form the orthogonal arrangement of the first dipole element 20 and the second dipole element 60.

Figure 2:
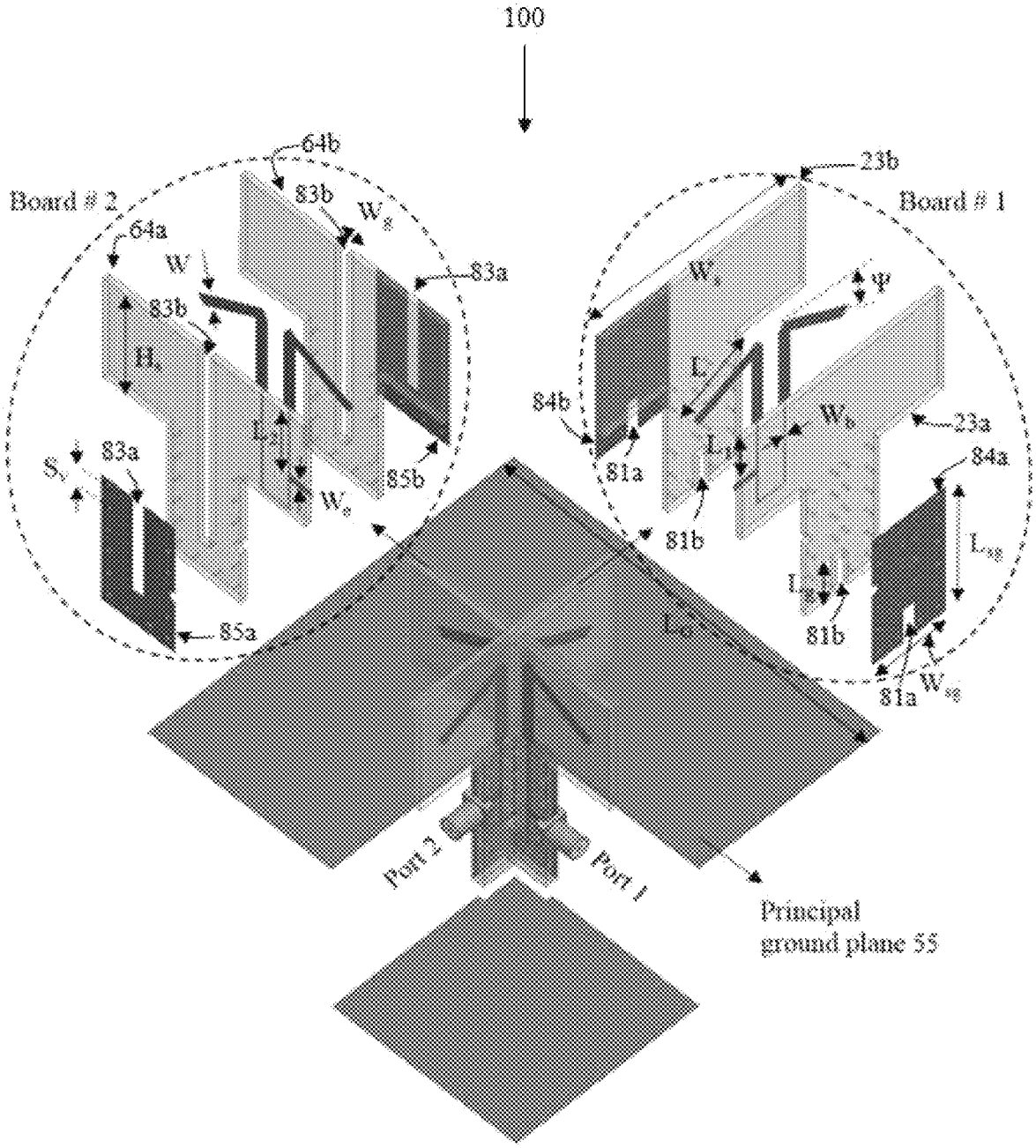
FIG. 2 is an exploded perspective view of the basic geometry of one embodiment of the crossed-dipole antenna of the present disclosure based on collocation of the two dipole elements of FIGS. 1B-1C. A principal ground plane has been split to display the bent dipoles, baluns, sub-ground planes, and top and bottom substrates. A quadrant of the cross slot is shown in split ground plane.
Figure 6:
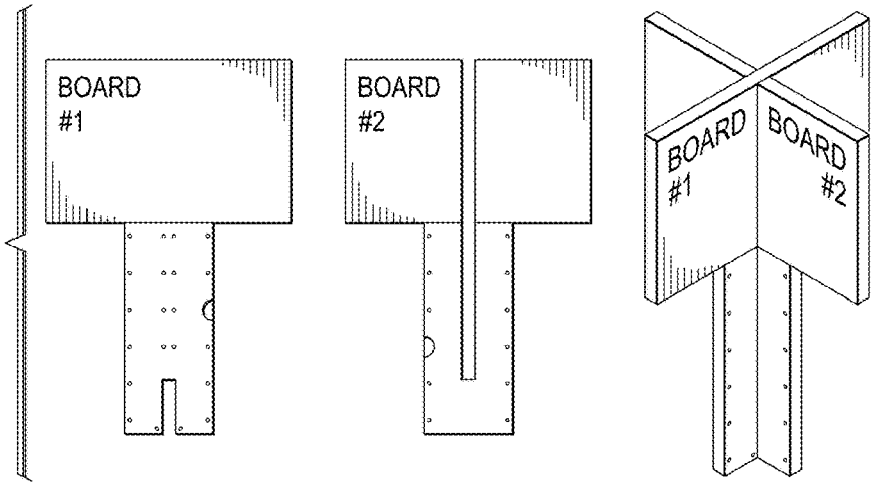
FIG. 6 is a photograph showing a fabricated embodiment of the crossed-dipole antenna, including a side view of individual unassembled boards (#1 and #2) and the collocated (assembled) crossed dipole without a principal ground plane interface.

An implementation of a design of one non-limiting embodiment of an example of a crossed-dipole antenna of the present disclosure is illustrated in FIG. 2 and is designated therein by the general reference numeral 100. For each polarization, a bent dipole antenna (e.g., a dipole element or an antenna assembly) is placed or disposed between two substrates of 0.06-inch thickness. For example, the first dipole element 20 is disposed between substrates 64*a* and 64*b*, and the second dipole element 60 is disposed between substrates 23*a* and 23*b*. To interlock collocated dipoles, a short gap 81*b* and a long gap 83*b* (also see FIG. 6), are cut into boards #1 and #2, respectively. Cutting the gaps 81*b* and 83*b* into two boards provides two slits 81*a* and 83*a* with different lengths on the sub-ground planes. For example, sub-ground planes 84*a* and 84*b* (between which the second dipole element 60 may be disposed) may include slit 81*a*, and sub-ground planes 85*a* and 85*b* (between which the first dipole element 20 may be disposed) may include slit 83*a*. Although two boards appear differently, after collocation or assembly, both dipole elements (e.g., both the first and second dipole elements 20, 60 or one or more components thereof, such as the radiative elements of the first and second dipole elements 20, 60) experience a substantially identical environment (FIG. 6). The final dimensions of this non-limiting embodiment of the antenna, implemented using Rogers RO4003 laminate (dielectric constant $\varepsilon_r$=3.55), are provided in Table 1.

TABLE 1

Detailed Dimensions for One Fabricated Crossed-Dipole Antenna

| | Parameter | | | | | | | | | | | | | |
|---|---|---|---|---|---|---|---|---|---|---|---|---|---|---|
| | L | W | $L_G$ | $W_s$ | $H_s$ | $L_g$ | $L_1$ | $W_g$ | $L_{sg}$ | $W_{sg}$ | $W_e$ | $W_b$ | $S_v$ | $L_2$ |
| Value | 20 | 3 | 300 | 55 | 32 | 10.45 | 16 | 3.05 | 40 | 20 | 2 | 0.35 | 7 | 22.3 |

In Table 1, L represents the length of the dipole (e.g., the length of the radiating arms 22, 24 of the first dipole element 20), W represents the width of the dipole (e.g. the width of the radiating arms 22, 24), $L_G$ represents the length of the principal ground plane (e.g., the principal ground plane 55 of FIG. 2), $W_S$ represents the width of the substrate (e.g., the substrates 64*a*, 64*b*, 83*a*, 83*b*), $H_s$ represents the height of the substrate (e.g., the substrates 64*a*, 64*b*, 83*a*, 83*b*) above the principal ground plane, $L_g$ represents the length of the short gap (e.g., the short gap 81*b*), $L_1$ represents the length of the short branch of balun 1 (e.g., the second feedline 36 of the balun 32, $W_g$ represents the width of the gap (e.g., the long gap 83*b*), $L_{sg}$ represents the length of the sub-ground plane (e.g., the sub-ground planes 84*a*, 84*b*), $W_{sg}$ represents the width of sub-ground plane (e.g., the sub-ground planes 84*a*, 84*b*), $W_e$ represents the width of the balun stub (e.g., the tax extension 40 of the balun 32), $W_b$ represents the width of the balun (e.g., the balun 32), $S_v$ represents the spacing between vias (e.g., vias drilled into the sub-ground planes 84*a*, 84*b*, 85*a*, 85*b*), and $L_2$ represents the length of the short branch of balun 2 (e.g., the second feedline 76 of the balun 72). The dimensions in Table 1 are in units of millimeters.

To illustrate how the crossed-dipole antenna can achieve a high level of isolation, the major contributors to the cross coupling between the dipoles (e.g., between the first and second dipole elements 20, 60), $S_{aa}$, $S_{bb}$, and $S_{ab}$, are shown in FIG. 1A, wherein $S_{aa}$ is the coupling between the two radiative elements (e.g., between the radiative element 21 and the radiative element 61), $S_{bb}$ is the coupling between the two baluns 32 and 72, and $S_{ab}$ is the coupling between one radiative element and the orthogonally positioned balun. For example, $S_{ab}$ may correspond to the coupling between the first radiative element 21 and the balun 72 of the second dipole element 60.

Figure 3A:
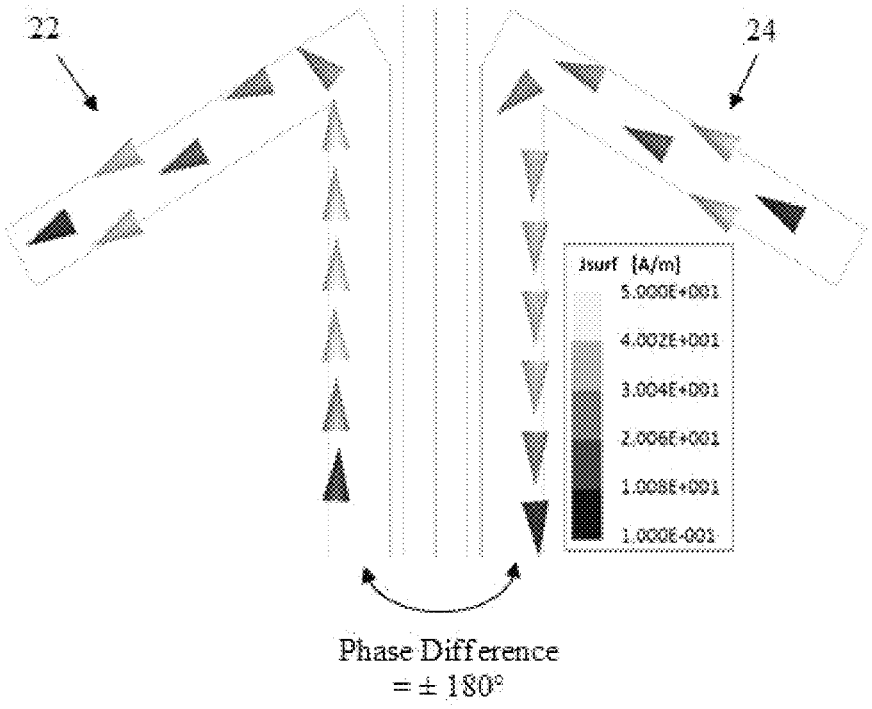
FIGS. 3A and 3B are schematics showing current distribution on crossed-dipole elements, with FIG. 3A showing the excited dipole and FIG. 3B showing the terminated dipole.
Figure 3B:
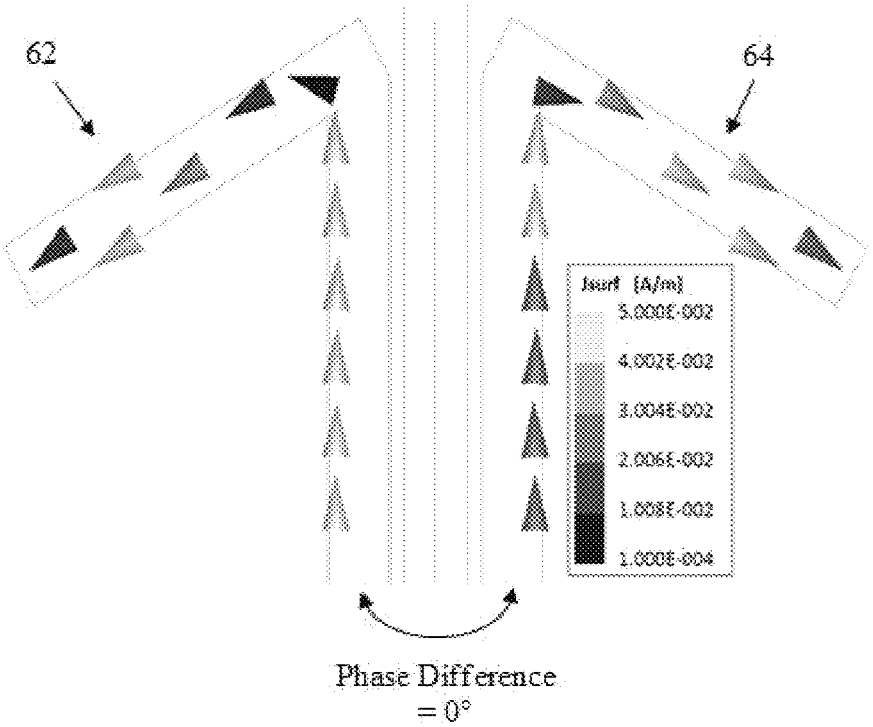

Decreasing each of these three coupling components (i.e., $S_{aa}$, $S_{bb}$, $S_{ab}$) enhances the port-to-port isolation ($S_{12}$). To implement each of the baluns, the stripline structure is employed. As shown in FIG. 2, in the stripline structure, the balun is sandwiched between two sub-ground planes. For example, the balun 32 from FIGS. 1A-1C is sandwiched between the two sub-ground planes 85*a* and 85*b* in FIG. 2, and the balun 72 from FIGS. 1A-1C is sandwiched between the two sub-ground planes 84*a* and 84*b*. This way, each of the baluns 32, 72 between its respective sub-ground planes is isolated from the other balun, so $S_{bb}$ is significantly reduced. Additionally, the balun structures are designed below the principal ground plane 55 and the interaction between the baluns and the antenna radiative elements (e.g., $S_{ab}$ and $S_{ba}$) are reduced. Furthermore, the ground planes 55, 85*a*, 85*b*, 84*a*, 84*b* reduce or block the spurious radiations of the baluns 32, 72, which leads to a lower cross-polarization level. Finally, $S_{aa}$ is reduced owing to symmetrical collocated radiative elements and parallel lines. That is, whatever effect the first radiative element 21 has on one pole (e.g., the first radiating arm 62) of the second radiative element 61, it has on the other pole (e.g., the second radiating arm 64) of the second radiative element 61 as well. Similarly, whatever effect the second radiative element 61 has on one pole (e.g., the first radiating arm 22) of the first radiative element 21, it has on the other pole (e.g., the second radiating arm 24) of the first radiative element 21 as well. Therefore, the potential difference at the end of a parallel line is substantially equal to zero. To elaborate on this symmetry effect, as an example, FIG. 3A depicts the current distributions on an excited dipole and FIG. 3B depicts the current distributions on a terminated dipole. To display these currents simultaneously, different scales are applied and the current scale on the excited dipole is a thousandfold greater than that of the terminated dipole. Note that, while the excited dipole is carrying two currents in the same direction, the terminated one has currents traveling in the opposite direction. This mode (e.g., on the arms 62, 64 of FIG. 3B) can neither propagate nor make a phase difference at the ends of parallel lines (of the terminated dipole of FIG. 3B). As such, the dipoles remain independent in terms of both port isolation and radiation pattern.

Simulation and Measurement Results

Figure 4A:
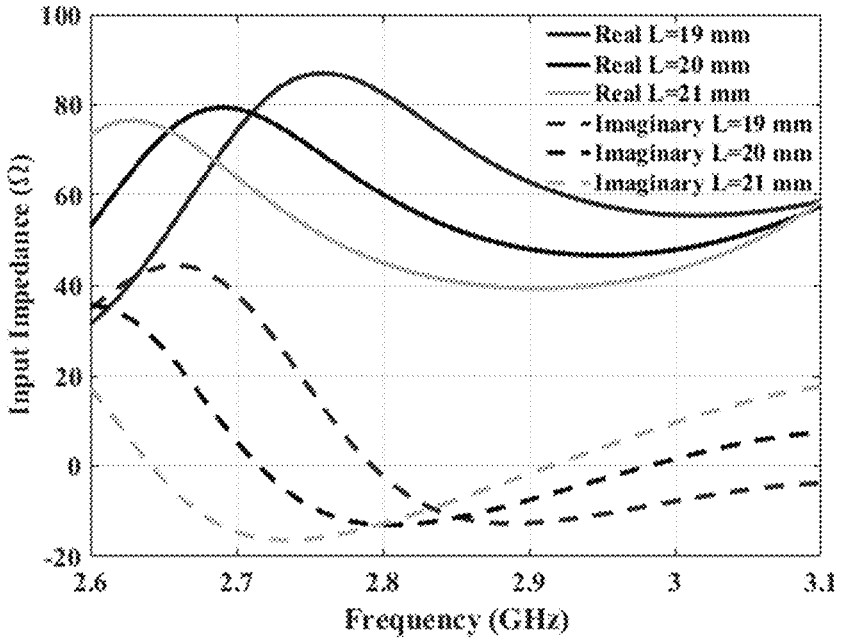
FIGS. 4A and 4B are graphs showing input impedance of the antenna with varied dipole dimensions, with FIG. 4A showing input impedance when antenna length L is varied and width W=3 mm, and FIG. 4B showing input impedance when antenna width is varied and length L=20 mm.
Figure 4B:
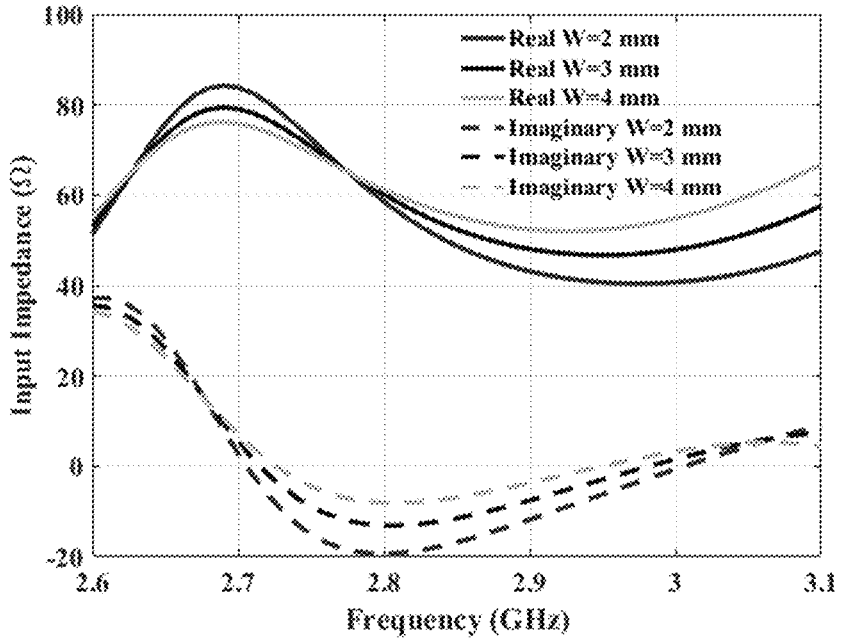

Having a group of key parameters, the disclosed crossed-dipole antenna shows versatility to match various frequency range with desired bandwidth. Among them, the length (L) of the radiating arm of the dipole element, its width (W), and its bend angle (Ψ) play the dominant roles. FIG. 4A depicts results of the parametric study on dipole length, and FIG. 4B depicts results of the parametric study on dipole width. While the length of the dipole determines the center resonance frequency, the bandwidth is mainly affected by the width of the dipole. It has been demonstrated that bent dipoles with a bend angle Ψ of 30° show the minimum off-boresight gain loss. In at least one non-limiting embodiment, the antenna is used as an element in a scanning array, with the dipole having a bend angle Ψ of 30° to achieve a minimum loss in scanning.

Figure 5:
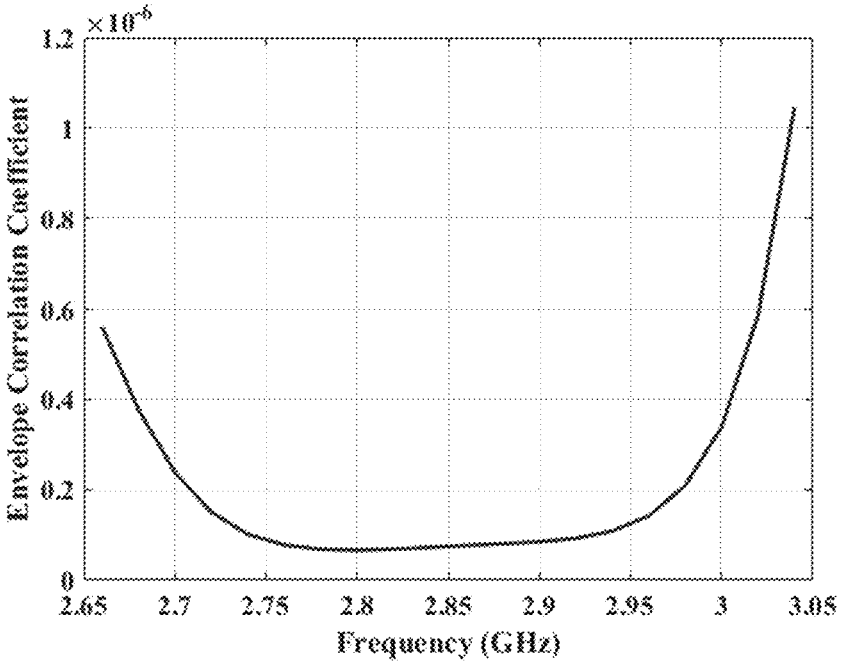
FIG. 5 is a graph showing the simulated envelope correlation coefficient of the antenna.

It has been demonstrated that a theoretical crossed-dipole configuration could be oriented so that the ECC is identically zero. However, the ECC for a physically implemented crossed-dipole is subject to degradation regarding the isolation between dipoles. The higher isolation is achieved, the lower ECC results. To examine the independency between two dipole radiation patterns in the presently disclosed design, the simulated ECC in Ansys HFSS using a far-field-based method with a frequency resolution of 10 MHz and the angular steps of 1 degree was computed and depicted in FIG. 5. This extremely low ECC result indicates the effectiveness of the disclosed antenna in diversity performance.

Figure 7:
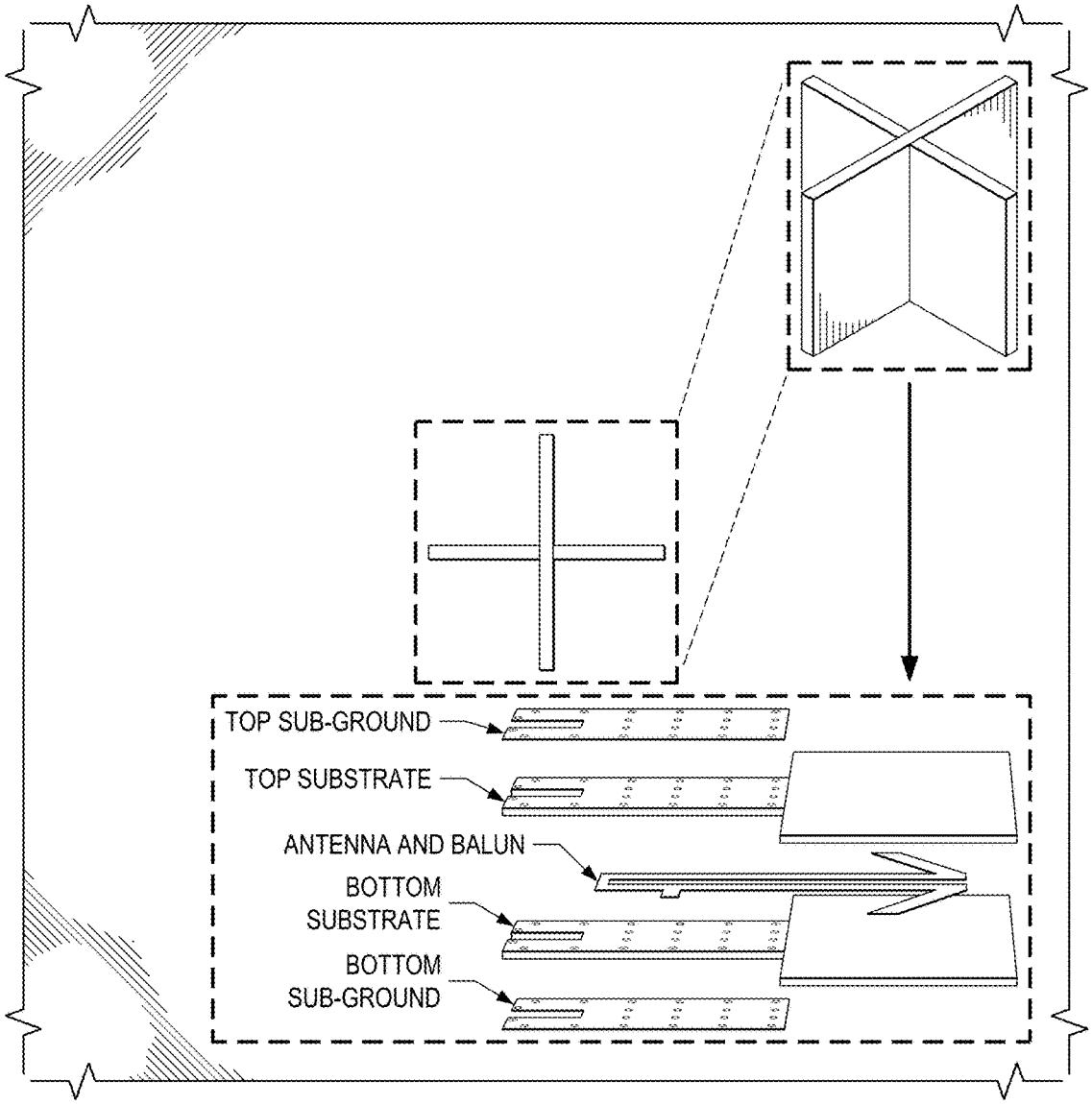
FIG. 7 is a photograph showing the portion of the assembled crossed dipole of FIG. 6 above the principal ground plane.
Figure 8:
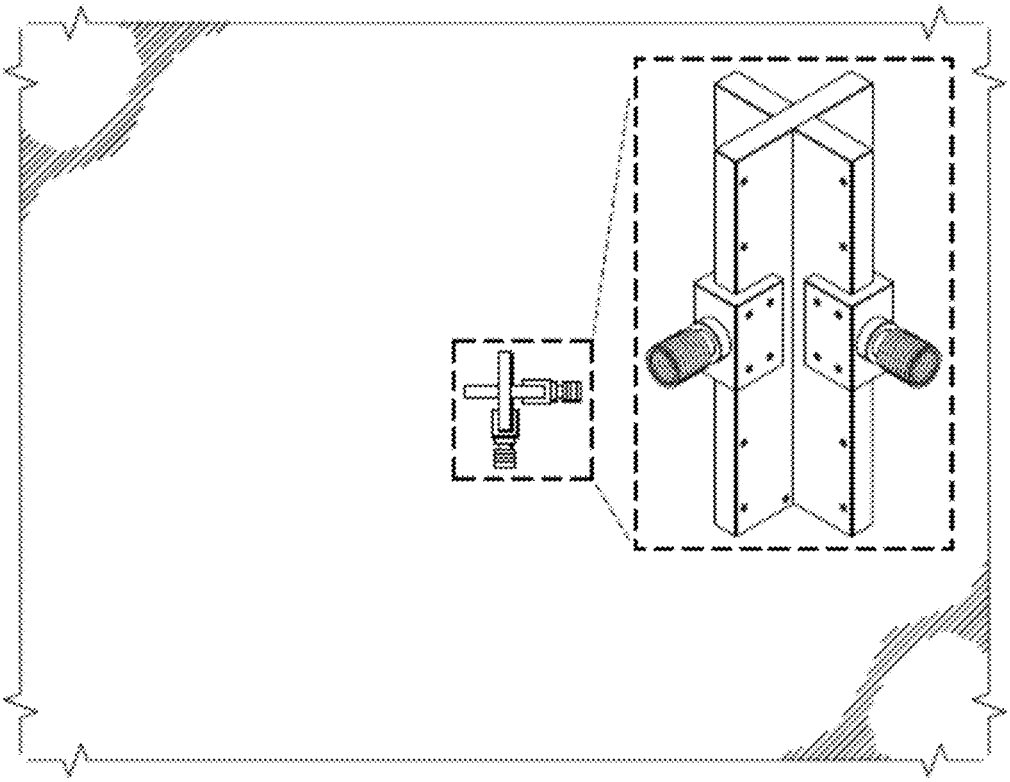
FIG. 8 is a photograph showing the portion of the assembled crossed dipole of FIG. 6 below the principal ground plane.

To verify the simulation results, the antenna in FIGS. 6-8 was fabricated at the Radar Innovations Laboratory of the University of Oklahoma. In at least one embodiment, each dipole element, parallel line, and balun is all designed in a single metal layer, making it possible to fabricate them simultaneously. This eliminates the necessity of additional soldering processes and consequently eliminates extra assembling loss. For each polarization, the dipole element along with corresponding balun and parallel lines were milled simultaneously on the bottom layer of the top substrate using an LPKF ProtoMat S103 (FIG. 7). The two stripline sub-ground planes were milled on the top layer of the top substrate and bottom layer of the bottom substrate. The two boards were bonded together using Rogers RO4450B bondply prepreg. Vias were drilled and electroplated to keep the two sub-ground planes at the same potential. A small section of PCB was removed to facilitate soldering the SMA connector to the feedline. The antenna assembly was mounted on a fairly large 300×300 $mm^2$ copper ground plane to decrease the edge effects.

Figure 9:
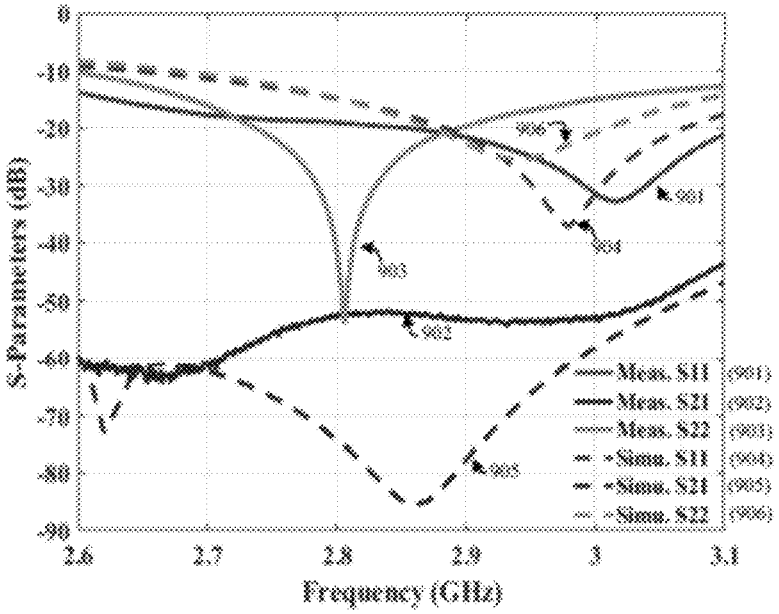
FIG. 9 shows the simulated and measured S-parameters of the antenna of FIGS. 6-8.

The S-parameters of the fabricated antenna was measured using an N5225A network analyzer from Agilent Technologies, calibrated using an E-Cal module. FIG. 9 shows simulation and measured S-parameters of the antenna. Both ports are matched to better than 15 dB in the entire frequency range. While measured S11 almost coincides with its simulation counterpart, S22 experiences a slight shift of center resonance frequency, which can be attributed to fabrication tolerances. A sensitive dimension of the crossed-dipole antenna is the width of the components of the balun. Any discrepancy between the widths of two branches of a balun can cause a frequency resonance shift and can result in an unequal power split between the two radiating arms of the dipole element, which can impair the isolation between two dipoles and the polarization purity. Nevertheless, the port-to-port isolation remains better than 52 dB over the entire bandwidth.

Figure 10A:
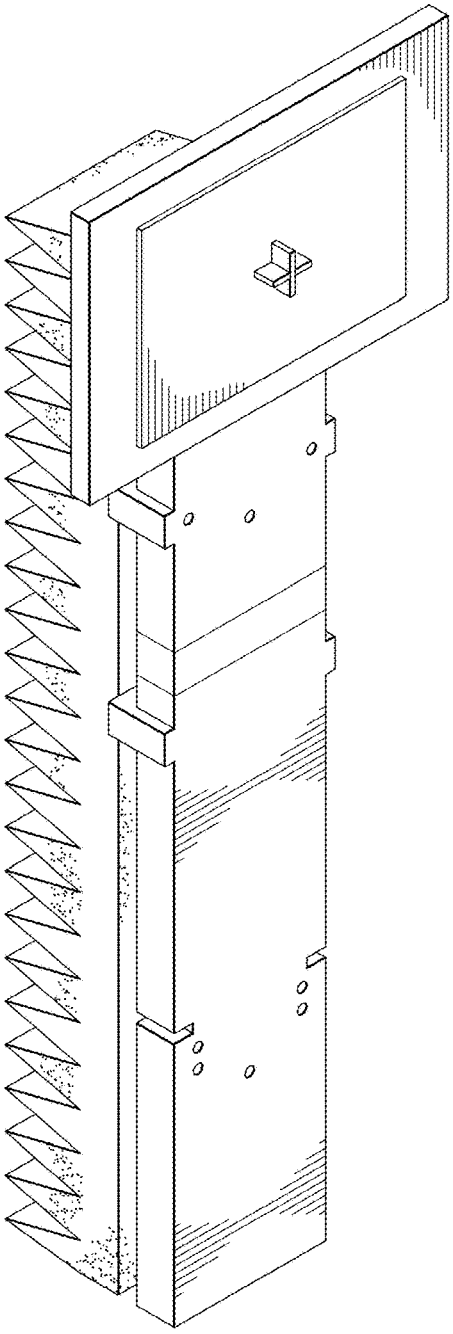
FIGS. 10A and 10B are photographs showing different views of a pattern measurement set-up for characterizing the crossed-dipole antenna, with FIG. 10A showing a side view and FIG. 10B showing a front view.
Figure 10B:
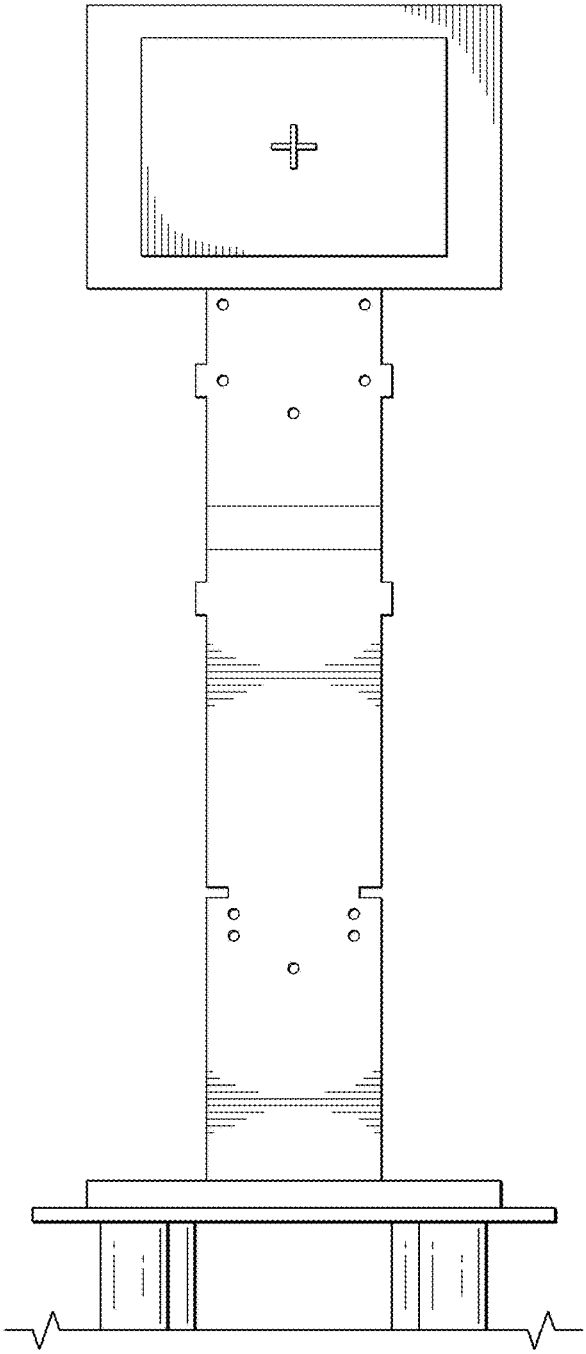
Figure 11A:
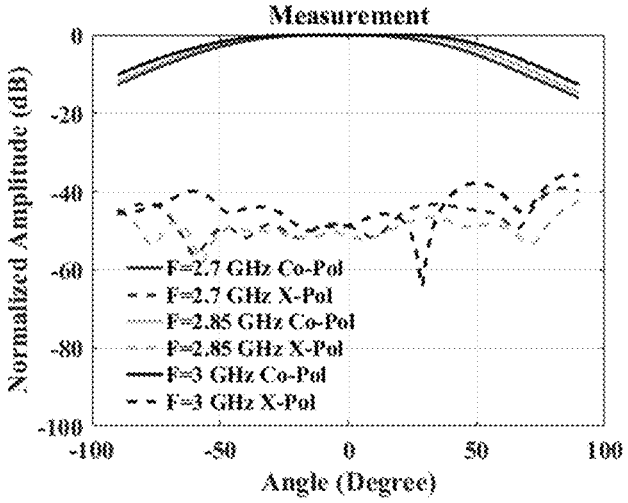
FIGS. 11A and 11B show measured and simulated patterns of the crossed-dipole antenna at the principal E-plane at frequencies of 2.7 GHz, 2.85 GHz, and 3.0 GHz.
Figure 11B:
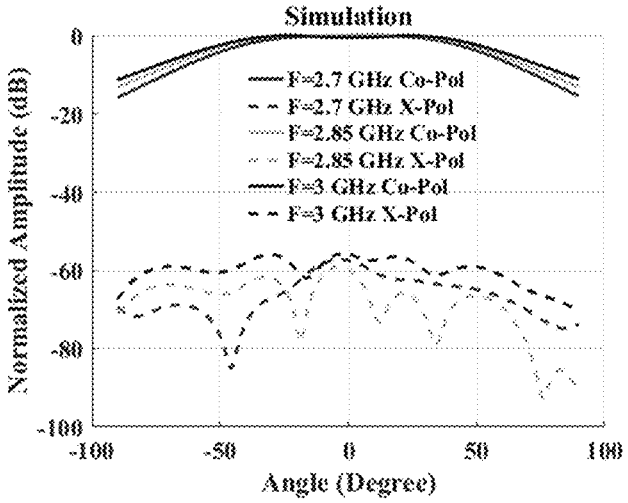
Figure 12A:
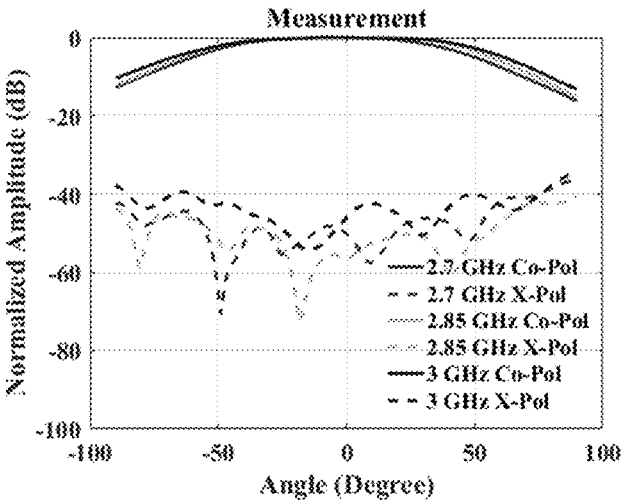
FIGS. 12A and 12B show measured and simulated patterns of the crossed-dipole antenna at the principal H-plane at frequencies of 2.7 GHz, 2.85 GHz, and 3.0 GHz.
Figure 12B:
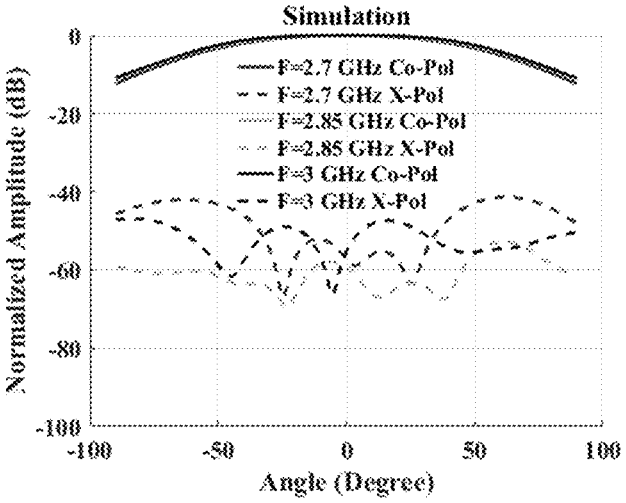

The antenna pattern was measured in the far field anechoic chamber at the Advanced Radar Research Center of the University of Oklahoma, and the measurement set-up is shown in FIGS. 10A and 10B. A fairly high stand of Rohacell 31HF foam from EVONIK Industries, with a dielectric constant of 1.05 is fabricated and mounted over the pedestal to emulate the simulation environment. To suppress any parasitic interference, the feeding cable is covered by absorbers as shown in FIGS. 10A and 10B. The orthogonal element is terminated in a 50Ω load. Following meticulous measurement considerations, we achieved a −50 dB boresight cross-polarization level at a center frequency of 2.85 GHz and better than −40 dB over an entire angle in principal planes.

The measured and simulated radiation patterns in the E and H principal planes at frequencies of 2.7 GHz, 2.85 GHz, and 3.0 GHz are illustrated in FIGS. 11A-12B. While the lowest cross polarization occurs at the center frequency, it rises at the beginning and the end of the frequency bandwidth, which matches the simulation results. This is because of the phase imbalance of the balun, which is optimized at the center frequency of 2.85 GHz and increases monotonically up to ±9° toward the beginning and the end of the frequency bandwidth. As such, the peak of co-polarization at corresponding E-plane is shifted by ±0.5° and cross-polarizations increase at these frequencies. In addition, contrary to the simulation, the cross-polarization level at ±90° increases, which is attributed to the edge diffraction of the ground plane and other measurement components at the back of the antenna. The antenna exhibits very low simulated cross-polarization levels in E-planes (below −50 dB). The discrepancy observed between the simulated and measured cross polarization in this plane is due to limitation of the measurement system. Because of geometrical symmetry of the structure, the orthogonal antenna has similar radiation characteristics.

Example 2

As noted MPAR is an amalgamation of weather observation and air surveillance radars. CPPAR was introduced for implementation in the MPAR project. Major advantages of CPPAR are azimuthal scan invariant beam and orthogonal polarization. A CPPAR demonstrator comprising a 2 m diameter cylinder populated by 96 columns of frequency scan patch antennas was designed and built. While it is a cost effective solution, the frequency scanning of the apparatus does not allow for full control of the array. Furthermore, different coupling mechanisms between horizontal (H) and vertical (V) ports result in a mismatch between corresponding H- and V-radiation patterns. Finally, the surface wave excited along the grounded dielectric deteriorates the array's functionality.

Figure 13A:
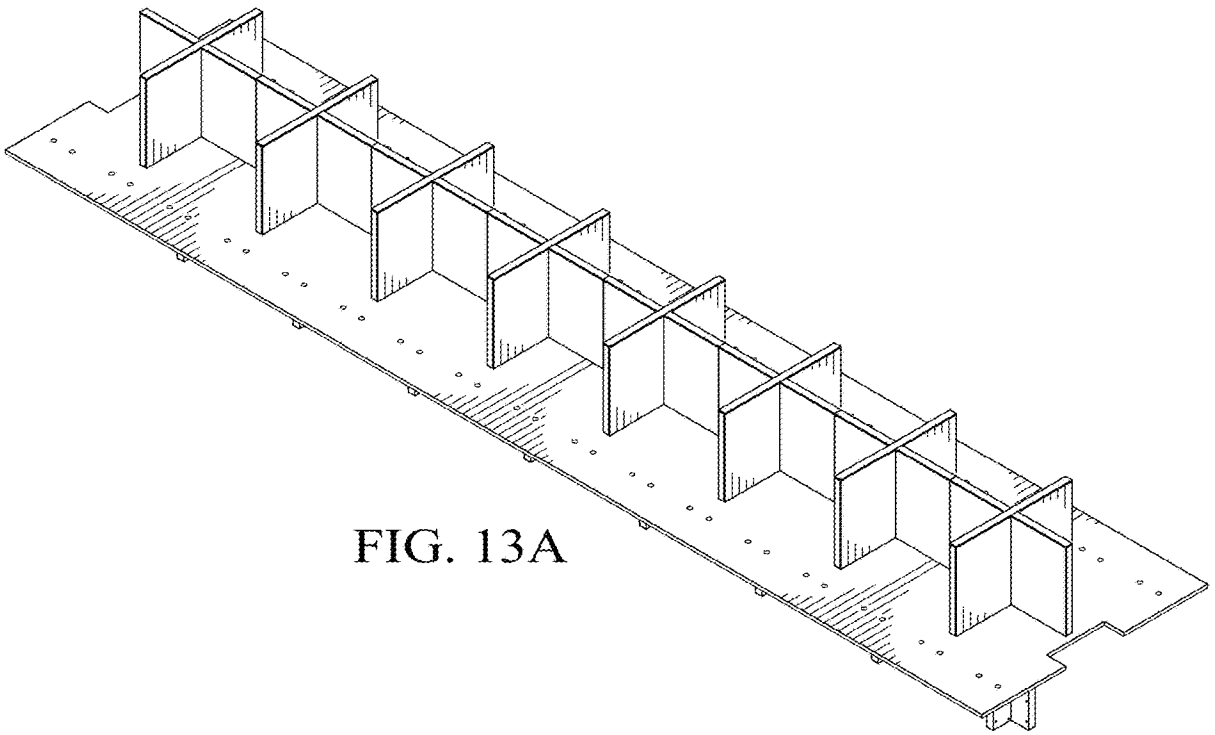
FIG. 13A is a photograph showing a plurality of the assembled crossed-dipole antennas of FIG. 6 assembled into a linear array.
Figure 13B:
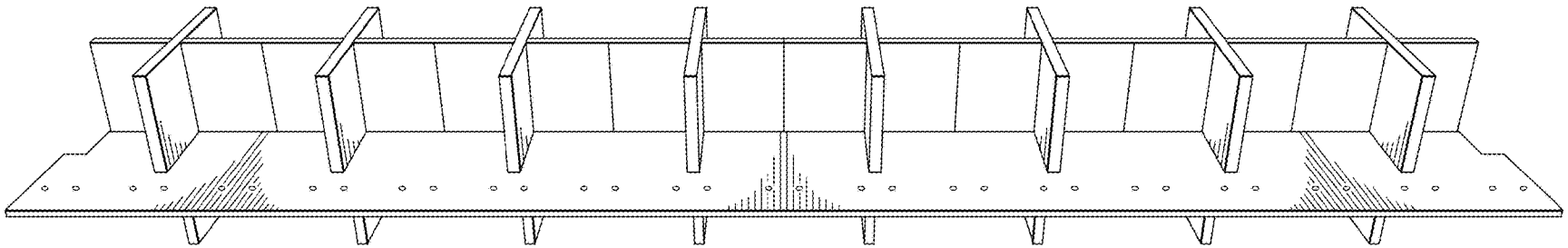
FIG. 13B is a photograph of the linear array of FIG. 13A taken from a different angle.

To improve the performance of the CPPAR, individually excited elements such as a linear array of the crossed-dipole antennas as described herein can be used. Examples of linear arrays of the presently disclosed antennas are shown in FIGS. 13A-13B. As described above, a high-level of port-to-port isolation is achieved due to stripline feeding for each polarization and symmetrical radiative element. Further suppression of the cross-polarizations in the principal planes is achieved through a unique sequential rotation of elements in the linear array configuration. Utilizing identical orthogonal radiation elements along with reduced coupling between adjacent elements results in matched horizontal and vertical co-polarization patterns.

Antenna Design

An isolated dual-polarization array requires an isolated dual-polarized element such as described in detail above in FIG. 2, which elaborates the exploded geometry of the crossed-dipole antenna element of the present disclosure. As noted, for each polarization, a bent (angled) dipole element connected to a parallel transmission line and located a quarter wavelength above the principal ground plane is used. A pair of U-shaped baluns below the principal ground plane, positioned orthogonally to one another, provide a pair of differential ports to the dipole elements.

The parallel transmission lines are attached to differential ports through a cross-shaped slot cut in the principal ground plane. The balun is positioned below the principal ground plane, which blocks the balun's spurious radiations. Further suppression of the balun's parasitic radiations is achieved through utilizing the stripline structure to implement the baluns. That is, a pair of sub-ground planes on both sides of each balun blocks their parasitic radiation and isolates the baluns from each other. Above the principal ground plane, two polarizations also remain isolated owing to orthogonal identical dipoles and parallel transmission lines. Simulated and measured S-parameters of the isolated antenna were discussed and shown in FIG. 9. The antenna in at least one embodiment comprises a balun having a pair of feedlines (branches) of unequal length. In at least certain embodiments, both ports are matched to better than 15 dB and the port-to-port isolation remains better than 52 dB over the entire frequency bandwidth.

Figure 14A:
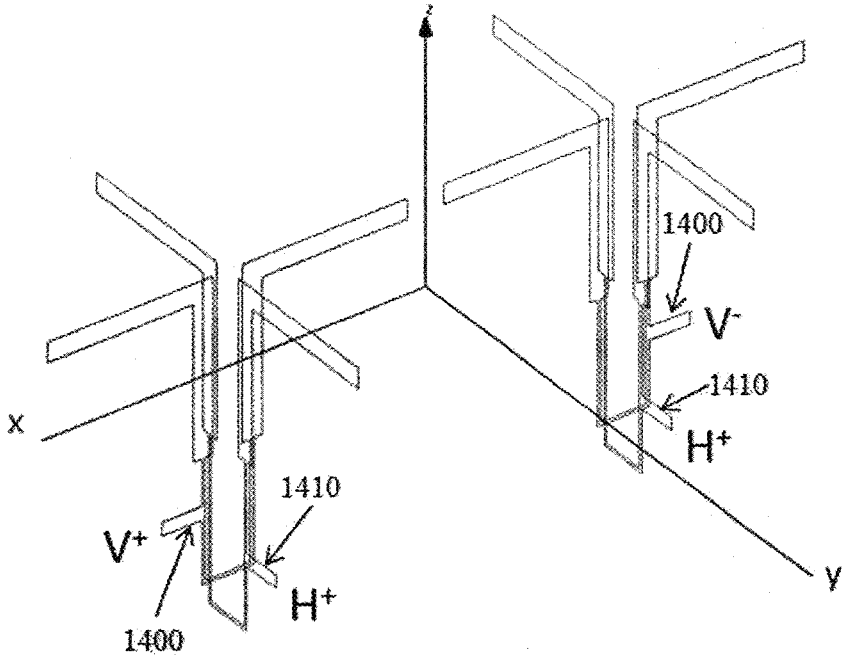
FIG. 14A is a schematic showing one embodiment of how the pair of dipole elements can be configured in a linear array antenna.
Figure 14B:
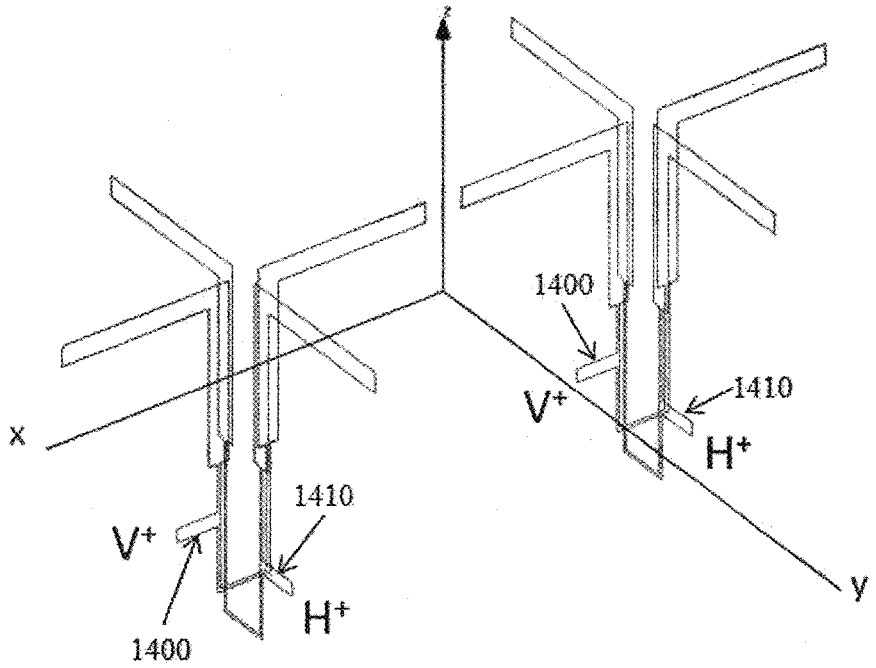
FIG. 14B is a schematic showing an alternate embodiment of how the pair of dipole elements can be configured in a linear array antenna.
Figure 14C:
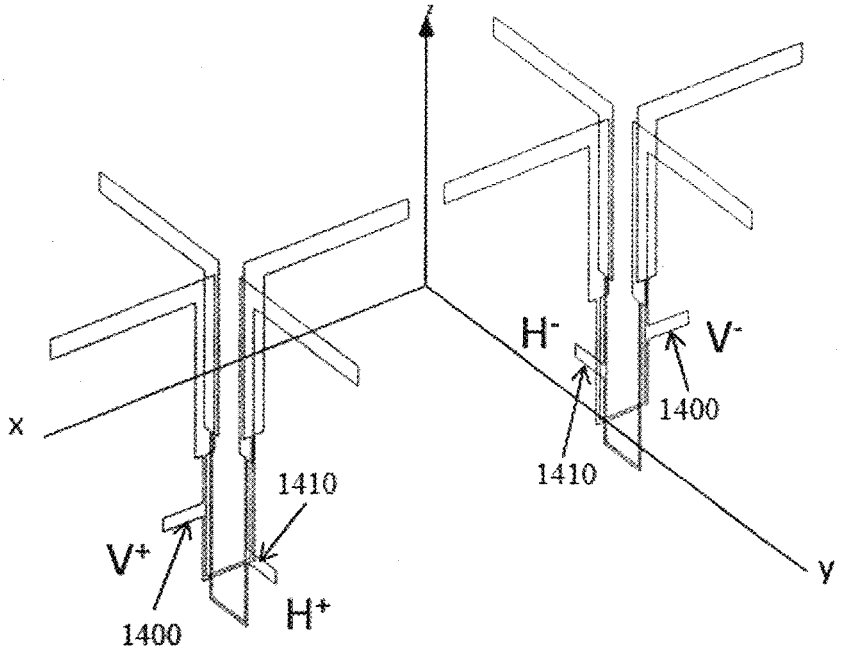
FIG. 14C is a schematic showing an alternate embodiment of how the pair of dipole elements can be configured in a linear array antenna.
Figure 14D:
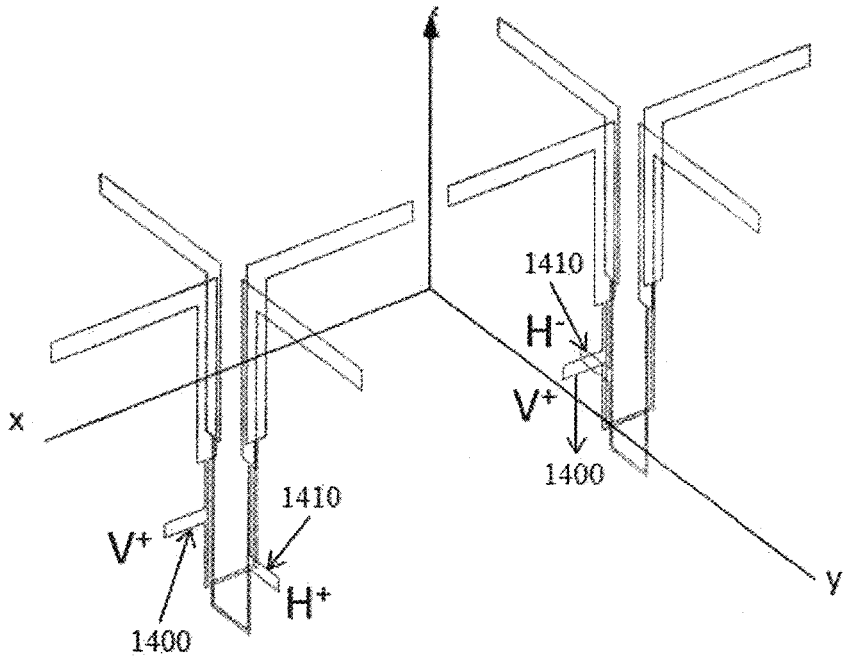
FIG. 14D is a schematic showing an alternate embodiment of how the pair of dipole elements can be configured in a linear array antenna.

The element parameters are readjusted and optimized to operate in an array with an active VSWR≤2 from 2.7 to 3 GHz while scanning up to ±45° in E-plane. The balun includes two branches of different lengths, which may be optimized at the center frequency to provide a differential signal to the dipole. Therefore the phase imbalance of the balun is set to zero at 2.85 GHz and increases monotonically up to ±9° toward the beginning and the end of the frequency bandwidth. As such, the peak of the dipoles' co-polarizations at their corresponding E-planes are tilted by ±0.5° and their cross-polarizations increase at these frequencies. In addition to the balun's phase imbalance, its amplitude imbalance along with fabrication tolerances can also impair the symmetry of the dipole radiation pattern in E-plane. Assuming a linear array of the disclosed crossed dipoles, it is problematic for vertical (V) elements in their corresponding E-plane. Accordingly, in order to return the symmetry to a linear array antenna and compensate for the elements' beam tilt, the array may be configured as represented in FIG. 14A, wherein in each pair of linear elements, the vertical elements 1400 are mirrored with respect to the center of the array, while the horizontal elements 1410 are identically oriented with respect to the center. Ports marked "−" can be excited 180° out of phase with respect to ports marked "+" to have the co-polar fields of the V-elements added in phase toward boresight. In this configuration, the matched points of V-elements radiation pattern are added toward boresight and the 180° phase difference results in cancellation of cross-polarizations. Other possible configurations of the pole elements of the antenna are shown in FIGS. 14B-14D.

Figure 14E:
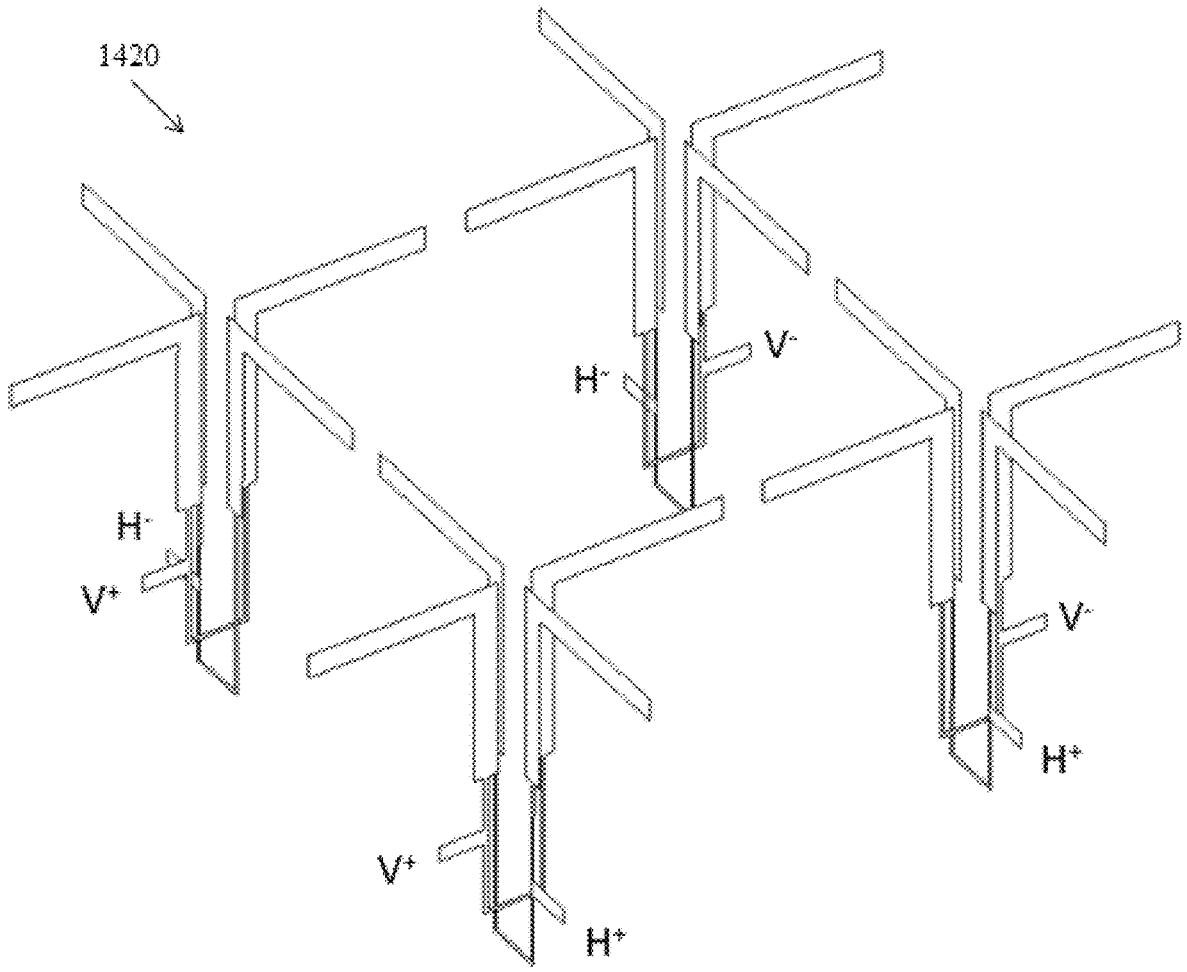
FIG. 14E is a schematic showing two pairs of the crossed-dipole elements of FIG. 14A arranged in a mirrored configuration forming a planar array.

Mirrored arrangements of elements in array configuration, though beneficial to cross-polarization reduction, are accompanied by undesirable side lobe problems. Such a problem can appear in some configurations of dual linear polarized patch antenna arrays. The properties of patch radiation patterns which cause such problem are identified and related to the asymmetry of the probe location with respect to the center of the patch antenna. The requirement of the element radiation pattern to avoid the increased side lobe is calculated. Radiation patterns of a symmetrical crossed-dipole antenna which meet the above-mentioned requirement were utilized to form planar arrays with different configurations. It was demonstrated that a simple crossed-dipole array 1420, arranged in mirrored configuration such as shown in FIG. 14E, can provide zero cross-polarization in both principal planes while having no side lobe problem. Such features are of great importance in many applications, including aircraft surveillance and weather observation.

Fabrication and Measurement

To implement the crossed-dipole antenna as illustrated in FIG. 2 (and elsewhere herein), for each polarization, an angled dipole element is placed between two substrates of Rogers RO4003 (although any other suitable high-frequency ceramic laminate circuit board material may be used as the substrate material). The dipole, parallel transmission line, and balun may all be integrally designed in a single metal layer, making it possible to fabricate them simultaneously, thereby precluding additional soldering process and eliminating extra assembling loss. Two stripline sub-ground planes are milled on side layers of each balun and kept equipotential through vias, which are drilled and electroplated into two wafers.

Figure 15:
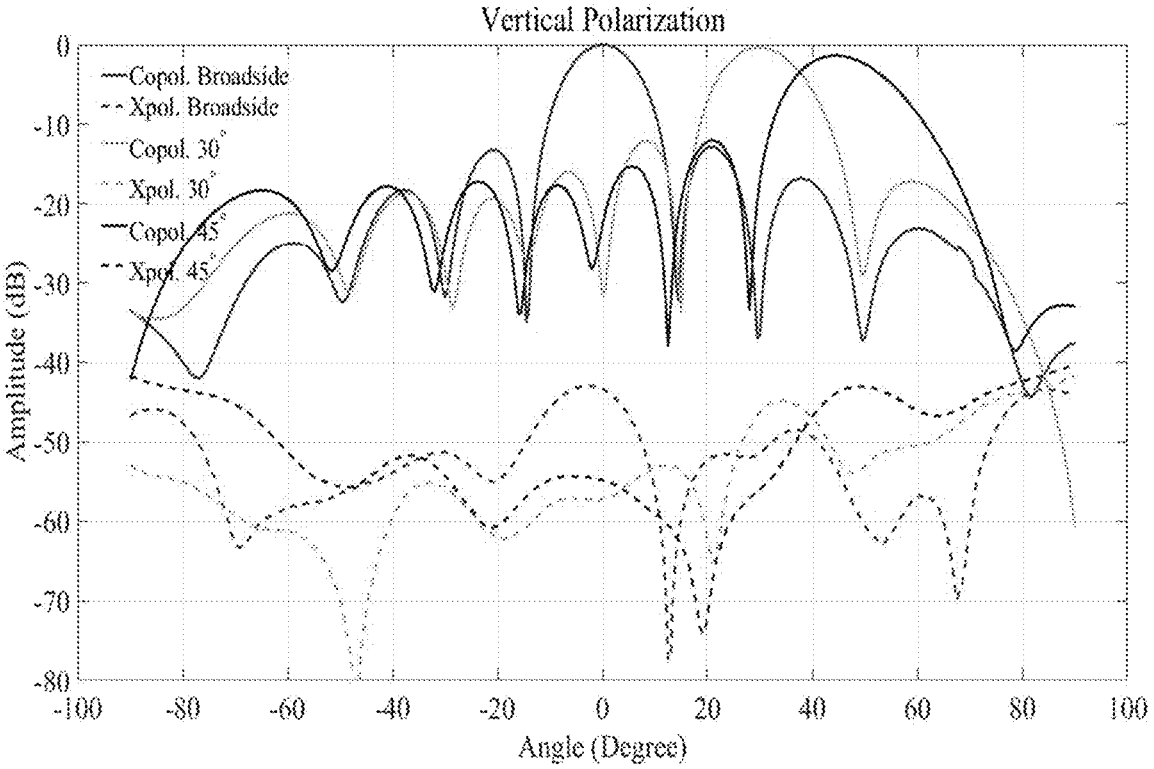
FIG. 15 shows the vertical polarization E-plane co-polarized (-) and cross-polarized (- -) realized gain beam scanning performance at 3 GHz.
Figure 16:
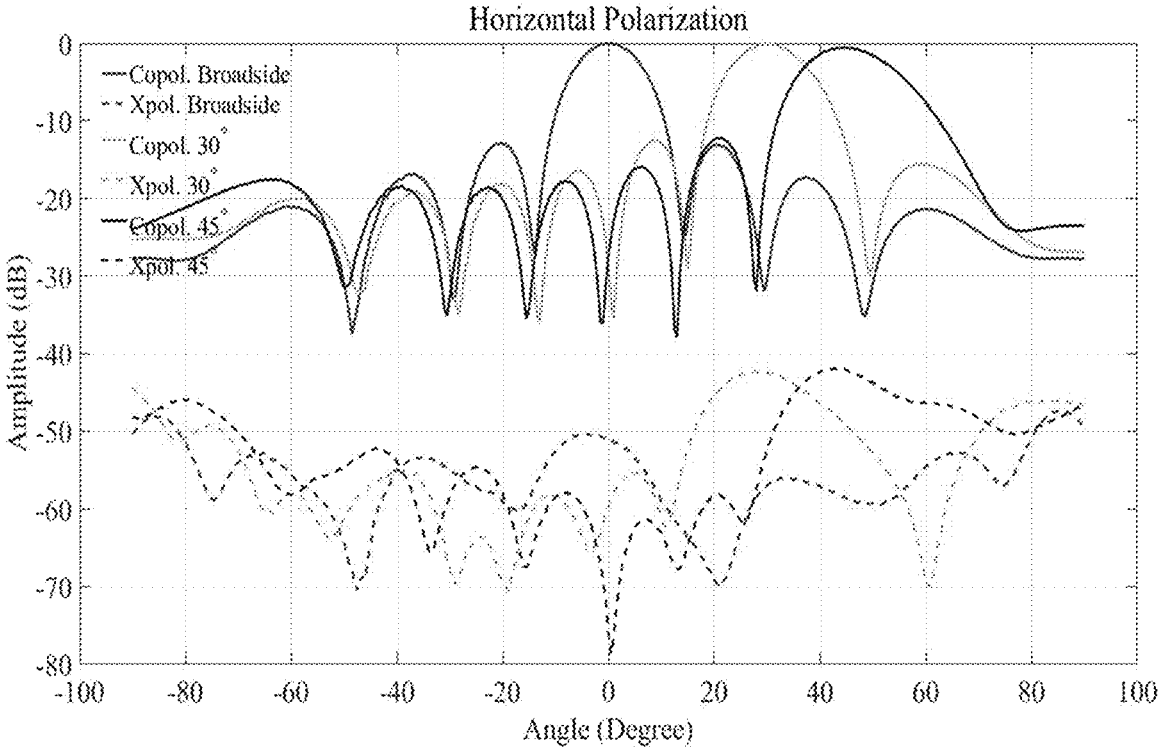
FIG. 16 shows the horizontal polarization E-plane co-polarized (-) and cross-polarized (- -) realized gain beam scanning performance at 3 GHz.

The vertical and horizontal radiation patterns of the 8-element linear array antenna at 3 GHz are depicted in FIGS. 15 and 16 (respectively). Due to greatest balun phase imbalance, the antenna shows the highest cross-polarization at this margin operating frequency. Nevertheless, the results indicate greater than 40 dB co- to cross-polarization difference while scanning across the entire principal plane.

Example 3

Figure 17:
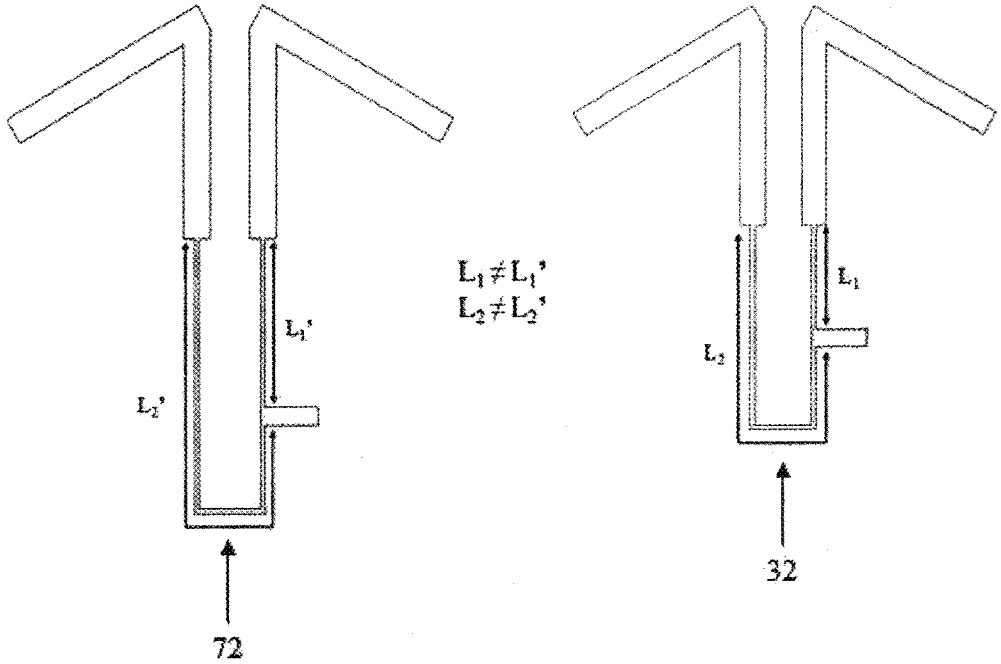
FIG. 17 shows the dipole embodiments of FIGS. 1B-C with the balun lengths indicated. In this embodiment, the total balun lengths are unequal.

In the embodiment of the antenna shown in FIGS. 1B and 1C, two dipole elements 20 and 60 and their respective baluns are the same except for the lengths of the baluns, wherein the length of the second feedline 36 of the first dipole element 20 is not equal to the length of the second feedline 76 of the second dipole element 60, and $L_B$ of the first dipole element 20 is not equal to $L_B$ of the second dipole element 60 (in FIGS. 1B-1C). This configuration avoids an intersection between the lower ends (e.g., horizontal portions) 38 and 78 of the baluns 32, 72 (e.g., see FIG. 1A). This embodiment is repeated in FIG. 17, which shows $L_1'$ is not equal to $L_1$, and $L_2'$ is not equal to $L_2$. In this embodiment of the crossed-dipole antenna, the first balun 32 has a first total balun length and the second balun 72 has a second total balun length, and the first total balun length and the second total balun length are unequal.

Figure 18:
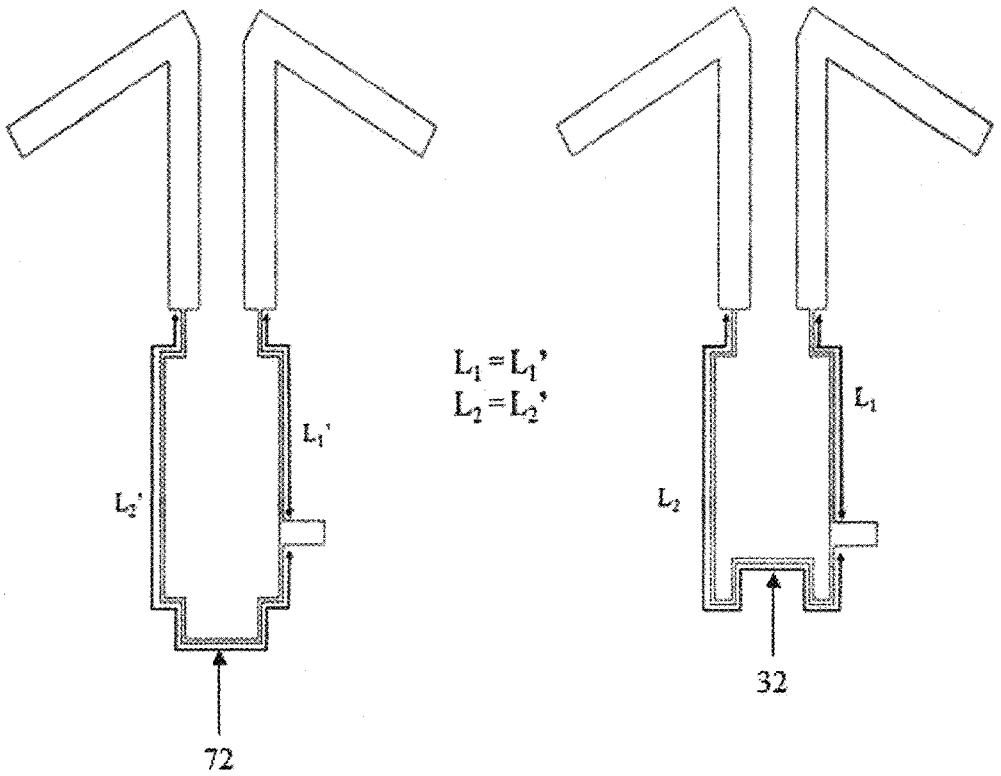
FIG. 18 shows an alternate dipole embodiment in which the baluns of the two dipoles have "U-shaped" lower end configurations (one inverted, one non-inverted) such that the total balun lengths are equal or substantially equal.
Figure 19:
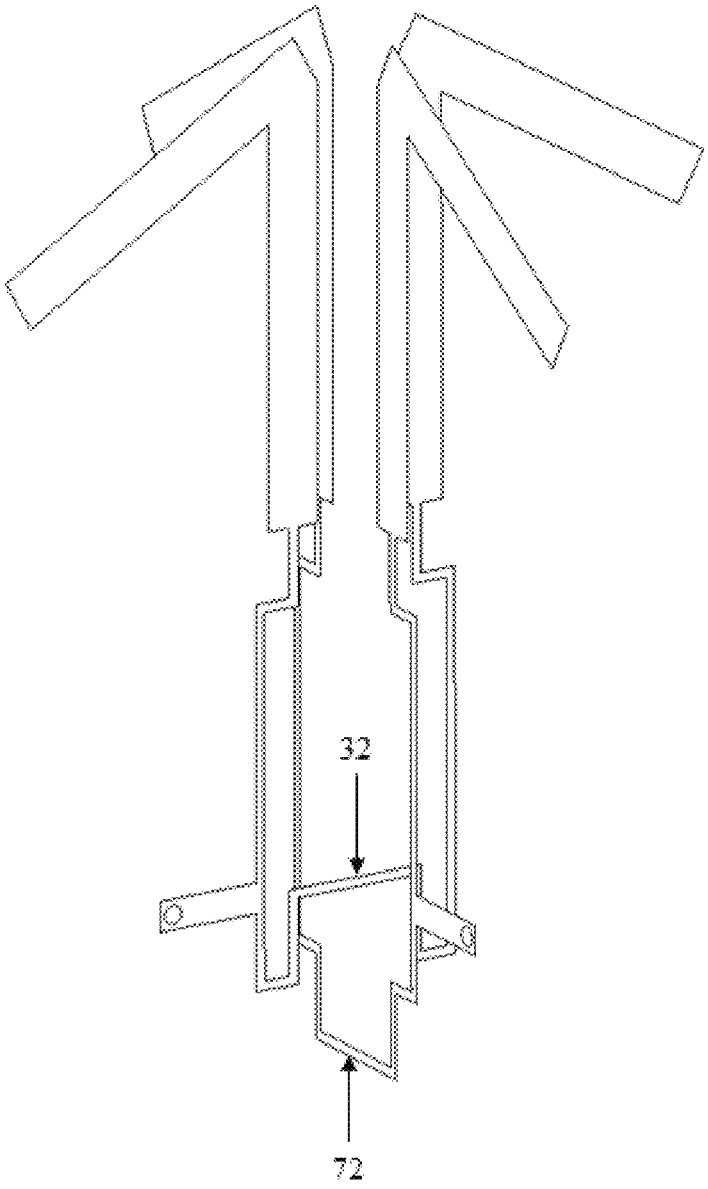
FIG. 19 shows a crossed dipole antenna comprising the two dipole elements of FIG. 18 in orthogonal orientation.
Figure 20:
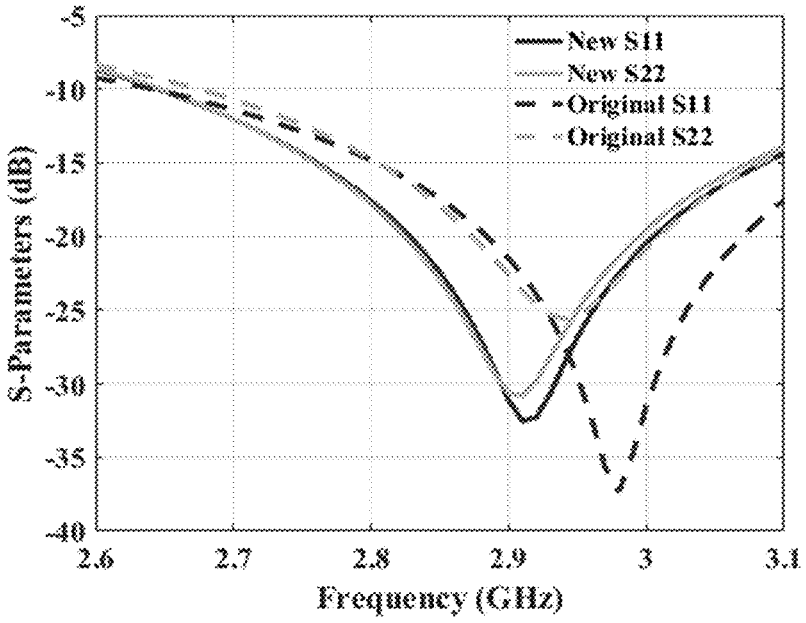
FIG. 20 shows a comparison of the S-parameters of the crossed dipole antennas based on the dipole configurations of FIGS. 1B-C ("original") and of FIG. 18 ("new").
Figure 21:
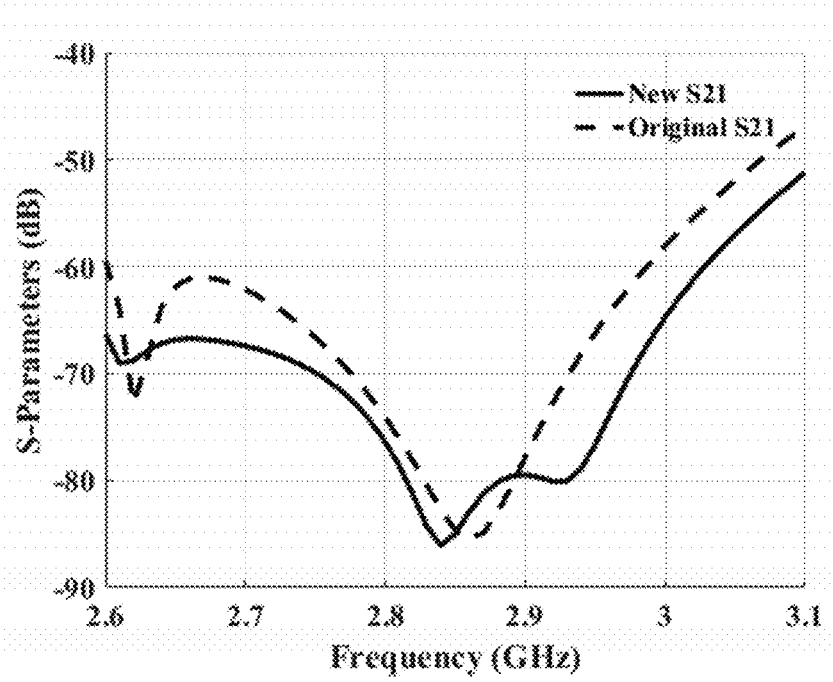
FIG. 21 shows a comparison of the port isolation of the crossed dipole antennas based on the dipole configurations of FIGS. 1B-C ("original") and of FIG. 18 ("new").
Figure 22:
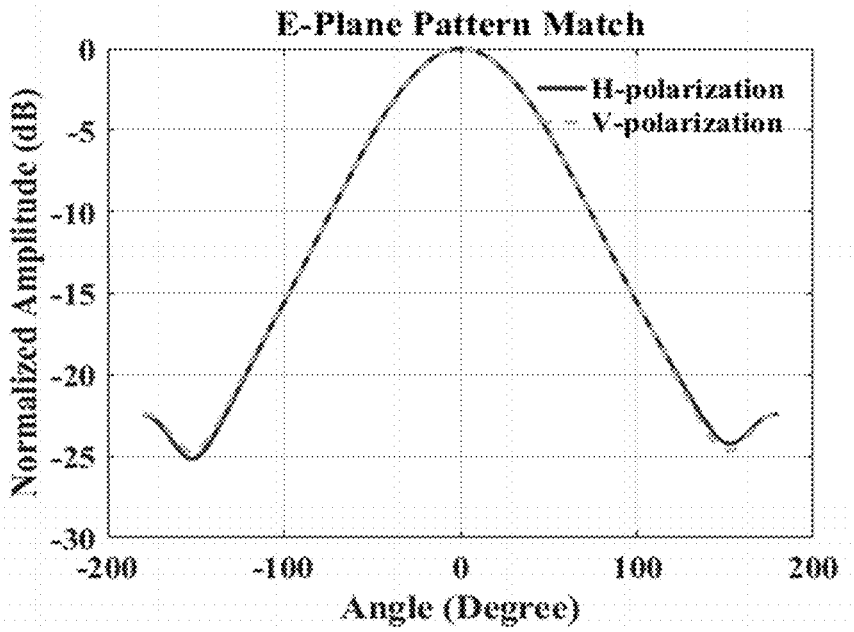
FIG. 22 shows the pattern match in E-plane of the crossed-dipole antenna of FIG. 19.
Figure 23:
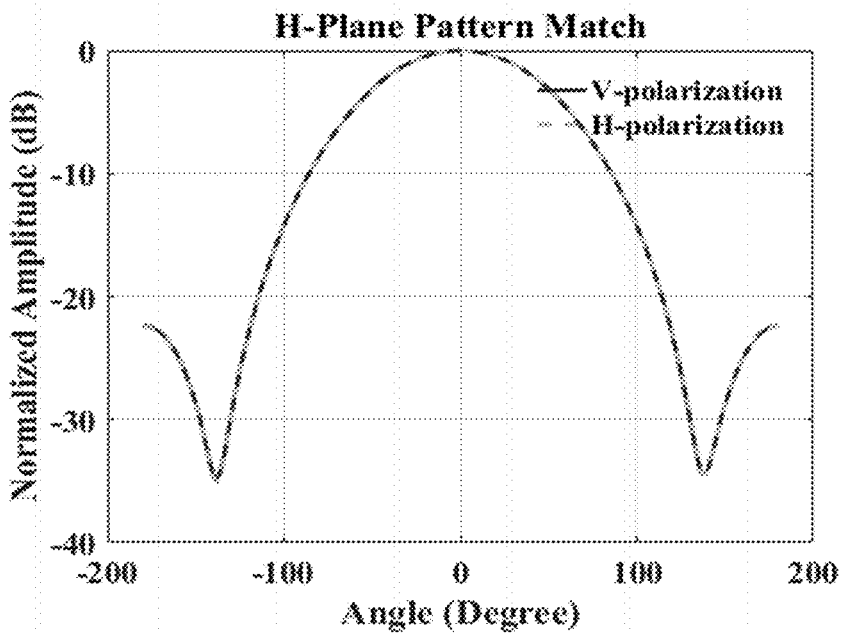
FIG. 23 shows the pattern match in H-plane of the crossed-dipole antenna of FIG. 19.

In an alternate embodiment shown in FIGS. 18-19, a crossed-dipole antenna is shown and has the same configuration as the embodiment shown in FIGS. 1A-1C, except the shape of the feedlines in the baluns is modified. In this embodiment, a feedline length $L_1'$ of the first dipole is the same as a feedline length $L_1$ of the second dipole, and a feedline length $L_2'$ of the first dipole is the same as a feedline length $L_2$ of the second dipole. In this embodiment, the total lengths of the feedlines of the baluns of each dipole are the same. The embodiment of FIGS. 18-19 differ from the embodiment of FIGS. 1A-C in the configuration of the lower end of the balun of each dipole. In the embodiment of FIGS. 1A-C, the lower end of the balun 32 has a horizontal portion 38 (FIG. 1B) and the lower end of the balun 72 has a horizontal portion 78 (FIG. 1C). In the embodiment of FIG. 18, the lower end of the balun of the left-hand dipole has a U shape and the lower end of the balun of the right-hand dipole has an inverted U shape. In this way, the total lengths of feedlines are the same for each dipole, unlike in the embodiment of FIGS. 1A-C, but the baluns can still cross without intersecting when positioned orthogonal to one another. In this embodiment of the crossed-dipole antenna, the first balun has a first total balun length and the second balun has a second total balun length, and the first total balun length and the second total balun length are equal (unlike the embodiment of FIG. 1A). The result of this "U-shaped" lower end modification and equal balun feedline lengths in the two dipoles is that the embodiment of FIG. 19 shows a better performance than the crossed-dipole embodiment of FIGS. 1A-C. For example, FIG. 20 shows that the alternate embodiment of FIG. 19 (referred to in FIG. 20 as the "new" embodiment) has similar $S_{11}$ and $S_{22}$ parameters, as opposed to the embodiment of FIGS. 1A-C (referred to in FIG. 20 as the "original" embodiment), which has less similar, diverging, $S_{11}$ and $S_{22}$ parameters. FIG. 21 shows that the alternate ("new") embodiment of FIG. 19 has higher isolation over a wider bandwidth than the ("original") embodiment of FIGS. 1A-C. Further, as shown in FIGS. 22-23, the alternate embodiment of FIG. 19 has virtually identical H-polarization and V-polarization patterns in the E-plane and H-plane. In summary, the alternate configuration of the baluns of FIGS. 18-19 result in a better match between parameters $S_{11}$ and $S_{22}$, greater port isolation over a wider bandwidth, and a higher match between corresponding E-plane and H-plane patterns. Such features, and in particular identical radiation patterns, are of particular value in applications where the element functions in an array and matched co-polarizations are required, such as for weather observation.

While the present disclosure has been described in connection with certain embodiments so that aspects thereof may be more fully understood and appreciated, it is not intended that the present disclosure be limited to these particular embodiments. On the contrary, it is intended that all alternatives, modifications and equivalents are included within the scope of the present disclosure. Thus the examples described above, which include particular embodiments, will serve to illustrate the practice of the present disclosure, it being understood that the particulars shown are by way of example and for purposes of illustrative discussion of particular embodiments only and are presented in the cause of providing what is believed to be the most useful and readily understood description of procedures as well as of the principles and conceptual aspects of the presently disclosed methods and compositions. Changes may be made in the structures of the various components described herein, or the methods described herein without departing from the spirit and scope of the present disclosure.

What is claimed is:

1. A crossed-dipole antenna comprising:

a first dipole element comprising a first pair of radiating arms, a first parallel transmission line extending from the first pair of radiating arms, and a first balun extending from the first parallel transmission line;

a second dipole element comprising a second pair of radiating arms, a second parallel transmission line extending from the second pair of radiating arms, and a second balun extending from the second parallel transmission line; and a principal ground plane that separates the first parallel transmission line from the first balun and the second parallel transmission line from the second balun, wherein the first parallel transmission line, the second parallel transmission line, the first balun, and the second balun are perpendicular to the principal ground plane, wherein the first pair of radiating arms is orthogonal to the second pair of radiating arms, wherein the first parallel transmission line is orthogonal to the second parallel transmission line, and wherein the first balun is orthogonal to the second balun.

2. The crossed-dipole antenna of claim 1, further comprising:

a first pair of substrates supporting the first dipole element; and a second pair of substrates supporting the second dipole element.

3. The crossed-dipole antenna of claim 1, further comprising:

a first pair of sub-ground plane shielding surfaces sandwiching the first balun; and a second pair of sub-ground plane shielding surfaces sandwiching the second balun.

4. The crossed-dipole antenna of claim 1, wherein a bend angle $\Psi$ of the first pair, the second pair, or both the first pair and the second pair is 30°.

5. The crossed-dipole antenna of claim 1, wherein the first parallel transmission line and second parallel transmission line have a length of a quarter wavelength.

6. The crossed-dipole antenna of claim 1, wherein the first balun has a first total balun length and the second balun has a second total balun length, and wherein the first total balun length and the second total balun length are unequal.

7. The crossed-dipole antenna of claim 1, wherein the first balun has a first total balun length and the second balun has a second total balun length, and wherein the first total balun length and the second total balun length are equal.

8. The crossed-dipole antenna of claim 7, wherein the first balun has a lower end having a U-shaped portion and the second balun has a lower end having an inverted U-shaped portion.

9. A crossed-dipole antenna comprising:

a first dipole element comprising:

a first radiating arm;

a second radiating arm opposing the first radiating arm, wherein the first radiating arm and the second radiating arm share a first common axis;

a first parallel transmission line comprising a first branch extending from the first radiating arm and a second branch extending from the second radiating arm; and a first balun comprising a first feedline extending from the first branch, a second feedline extending from the second branch, and a first tab extension, wherein the first radiating arm and the second radiating arm each have a bend angle $\Psi$ with the first common axis, and wherein $1° \leq \Psi \leq 90°$;

a first pair of substrates supporting the first dipole element;

a second dipole element comprising:

a third radiating arm;

a fourth radiating arm opposing the third radiating arm, wherein the third radiating arm and the fourth radiating arm share a second common axis;

a second parallel transmission line comprising a third branch extending from the third radiating arm and a fourth branch extending from the fourth radiating arm; and a second balun comprising a third feedline extending from the third branch, a fourth feedline extending from fourth branch, and a second tab extension, wherein the third radiating arm and the fourth radiating arm each have a bend angle $\Psi$ with the second common axis, wherein $1° \leq \Psi \leq 90°$, wherein the first radiating arm and the second radiating arm are orthogonal to the third radiating arm and the fourth radiating arm, wherein the first parallel transmission line is orthogonal to the second parallel transmission line, and wherein the first balun is orthogonal to the second balun;

a second pair of substrates supporting the second dipole element;

a principal ground plane separating the first parallel transmission line and the second parallel transmission line from the first balun and the second balun, wherein the first parallel transmission line, the second parallel transmission line, the first balun, and the second balun are perpendicular to the principal ground plane;

a first pair of sub-ground plane shielding surfaces sandwiching the first balun; and a second pair of sub-ground plane shielding surfaces sandwiching the second balun.

10. The crossed-dipole antenna of claim 9, wherein the first feedline has a width that is less than a width of the first branch, wherein the second feedline has a width that is less than a width of the second branch, wherein the third feedline has a width that is less than a width of the third branch, and wherein the fourth feedline has a width that is less than a width of the fourth branch.

11. The crossed-dipole antenna of claim 9, wherein a bend angle Ψ of at least one of the first radiating arm, the second radiating arm, the third radiating arm, or the fourth radiating arm is 30°.

12. The crossed-dipole antenna of claim 9, wherein the first parallel transmission line and the second parallel transmission line have a length of a quarter wavelength.

13. The crossed-dipole antenna of claim 9, wherein the first balun has a first total balun length and the second balun has a second total balun length, and wherein the first total balun length and the second total balun length are unequal.

14. The crossed-dipole antenna of claim 9, wherein the first balun has a first total balun length and the second balun has a second total balun length, and wherein the first total balun length and the second total balun length are equal.

15. The crossed-dipole antenna of claim 14, wherein the first balun has a lower end having a U-shaped portion and the second balun has a lower end having an inverted U-shaped portion.

16. The crossed-dipole antenna of claim 9, wherein the first tab extension is attached to a first connector and the second tab extension is attached to a second connector.

17. An antenna array comprising:

a plurality of crossed-dipole antennas, wherein each of the crossed-dipole antennas comprises:

a first dipole element comprising a first pair of radiating arms, a first parallel transmission line extending from the first pair of radiating arms, and a first balun extending from the first parallel transmission line;

a second dipole element comprising a second pair of radiating arms, a second parallel transmission line extending from the second pair of radiating arms, and a second balun extending from the second parallel transmission line; and a ground plane that separates the first parallel transmission line from the first balun and the second parallel transmission line from the second balun, wherein the first parallel transmission line, the second parallel transmission line, the first balun, and the second balun are perpendicular to the ground plane, wherein the first pair of radiating arms is orthogonal to the second pair of radiating arms, wherein the first parallel transmission line is orthogonal to the second parallel transmission line, and wherein the first balun is orthogonal to the second balun.

18. An antenna array comprising:

a plurality of crossed-dipole antennas, wherein each of the crossed-dipole antennas comprises:

a first dipole element comprising:

a first radiating arm;

a second radiating arm opposing the first radiating arm, wherein the first radiating arm and the second radiating arm share a first common axis;

a first parallel transmission line comprising a first branch extending from the first radiating arm and a second branch extending from the second radiating arm; and a first balun comprising a first feedline extending from the first branch, a second feedline extending from the second branch, and a first tab extension, wherein the first radiating arm and the second radiating arm each have a bend angle Ψ with the first common axis, and wherein $1° \leq \Psi \leq 90°$;

a first substrate supporting the first dipole element;

a second dipole element comprising:

a third radiating arm;

a fourth radiating arm opposing the third radiating arm, wherein the third radiating arm and the fourth radiating arm share a second common axis;

a second parallel transmission line comprising a third branch extending from the third radiating arm and a fourth branch extending from the fourth radiating arm; and a second balun comprising a third feedline extending from the third branch, a fourth feedline extending from fourth branch, and a second tab extension, wherein the third radiating arm and the fourth radiating arm each have a bend angle Ψ with the second common axis, wherein $1° \leq \Psi \leq 90°$, wherein the first radiating arm and the second radiating arm are orthogonal to the third radiating arm and the fourth radiating arm, wherein the first parallel transmission line is orthogonal to the second parallel transmission line, and wherein the first balun is orthogonal to the second balun;

a second substrate supporting the second dipole element;

a principal ground plane separating the first parallel transmission line and the second parallel transmission line from the first balun and the second balun, wherein the first parallel transmission line, the second parallel transmission line, the first balun, and the second balun are perpendicular to the principal ground plane;

a first pair of sub-ground plane shielding surfaces sandwiching the first balun; and a second pair of sub-ground plane shielding surfaces sandwiching the second balun.

19. An antenna array comprising:

a first crossed-dipole antenna comprising:

a first dipole element comprising a first pair of radiating arms, a first parallel transmission line extending from the first pair of radiating arms, and a first balun extending from the first parallel transmission line and comprising a first lower end having a first flat portion, and a second dipole element comprising a second pair of radiating arms, a second parallel transmission line extending from the second pair of radiating arms, and a second balun extending from the second parallel transmission line and comprising a second lower end having an inverted U-shaped portion; and a second crossed-dipole antenna comprising:

a third dipole element comprising a third pair of radiating arms, a third parallel transmission line extending from the third pair of radiating arms, and a third balun extending from the third parallel transmission line and comprising a third lower end having a second flat portion, and a fourth dipole element comprising a fourth pair of radiating arms, a fourth parallel transmission line extending from the fourth pair of radiating arms, and a fourth balun extending from the fourth parallel transmission line and comprising a fourth lower end having a U-shaped portion.

20. The antenna array of claim 19, wherein a first length of the first lower end and the second lower end is equal to a second length of the third lower end and the fourth lower end.

* * * * *